US007165774B2

(12) United States Patent
Adams

(10) Patent No.: US 7,165,774 B2
(45) Date of Patent: Jan. 23, 2007

(54) EXTERNAL WHEELED HEELING APPARATUS AND METHOD

(75) Inventor: Roger R. Adams, Hickory Creek, TX (US)

(73) Assignee: Heeling Sports Limited, Carrollton, TX (US)

( * ) Notice: Subject to any disclaimer, the term of this patent is extended or adjusted under 35 U.S.C. 154(b) by 0 days.

(21) Appl. No.: 11/471,365

(22) Filed: Jun. 19, 2006

(65) Prior Publication Data

US 2006/0232027 A1 Oct. 19, 2006

Related U.S. Application Data

(63) Continuation of application No. 10/369,063, filed on Feb. 18, 2003, now Pat. No. 7,063,336.

(51) Int. Cl.
*A63G 17/20* (2006.01)

(52) U.S. Cl. ..... 280/11.221; 280/841; 280/11.19; 280/11.27

(58) Field of Classification Search ..... 280/11.221, 280/7.1, 7.17, 11.19, 11.27, 841, 11.28, 43, 280/8, 11.223; 36/115
See application file for complete search history.

(56) References Cited

U.S. PATENT DOCUMENTS

| | | | |
|---|---|---|---|
| 132,474 | A | 10/1872 | Lindley |
| 202,191 | A | 4/1878 | Proctor |
| 234,030 | A | 11/1880 | Hadley et al. |
| 487,779 | A | 12/1892 | Schoen |
| 508,617 | A | 11/1893 | Hoerle |
| 579,577 | A | 3/1897 | Hanscom |
| 702,476 | A | 6/1902 | Price |
| 857,560 | A | 12/1907 | Vaughan |
| 881,079 | A | 3/1908 | Jolitz |
| 892,152 | A | 6/1908 | Harman |
| 966,821 | A | 8/1910 | Gaw |
| 968,020 | A | 8/1910 | Yandoll |
| 1,051,880 | A | 2/1913 | Glenn |
| 1,056,091 | A | 3/1913 | Dickson |
| 1,068,575 | A | 7/1913 | Demorey et al. |

(Continued)

FOREIGN PATENT DOCUMENTS

| | | | |
|---|---|---|---|
| AU | DES. 137579 | 6/1999 | |
| CA | 1-138-194 | 12/1982 | ..... 36/6 |
| CA | 1-239-017 | 7/1988 | ..... 36/6 |
| CA | 2258978 | 7/2000 | |
| CA | 2258980 | 7/2000 | |
| CN | 85 2 04533 U | 10/1986 | |
| CN | DES. ZL 98300231.2 | 1/1998 | |
| CN | ZL 97244602.8 | 4/1999 | |

(Continued)

OTHER PUBLICATIONS

Article in "Bulletin Board," Digital bytes and buzz, which contains an ad for "Street Flyers."

(Continued)

*Primary Examiner*—J. Allen Shriver
(74) *Attorney, Agent, or Firm*—Robert J. Ward

(57) ABSTRACT

An external wheeled heeling apparatus for walking and running and transitioning to rolling on a surface is provided. The apparatus includes a sole having a forefoot, an arch and a heel portion provided with a first side of the heel portion and a second side of the heel portion. The forefoot operable to engage the surface for walking and running. The apparatus further includes a first wheel operably coupled to rotate adjacent the first side of the heel portion and a second wheel operably coupled to rotate adjacent the second side of the heel portion.

18 Claims, 15 Drawing Sheets

U.S. PATENT DOCUMENTS

| | | | | |
|---|---|---|---|---|
| 1,189,329 | A | 7/1916 | Winagle | |
| 1,260,901 | A | 3/1918 | Hayhurst | |
| 1,369,849 | A | 3/1921 | Spencer | |
| 1,428,232 | A | 9/1922 | Holmen | |
| 1,502,087 | A | 7/1924 | Bunns | |
| 1,592,692 | A | 7/1926 | Hackett | |
| 1,600,075 | A | 9/1926 | Stoops | |
| 1,636,909 | A | 7/1927 | Haney | |
| 1,690,696 | A | 11/1928 | Norwood | |
| 1,702,591 | A | 2/1929 | Brown | |
| 1,866,006 | A | 7/1932 | Bergstrand | |
| 1,888,617 | A | 11/1932 | Bridi | |
| 1,975,661 | A | 10/1934 | Powell | 208/181 |
| 1,984,989 | A | 12/1934 | Reed | 36/8.3 |
| 1,998,624 | A | 4/1935 | Hughes | 36/35 |
| 2,060,391 | A | 11/1936 | Castagnola | 36/71 |
| 2,095,942 | A | 10/1937 | Wetterstrand | 36/2.5 |
| 2,113,477 | A | 4/1938 | Gilman | 36/8.3 |
| 2,114,461 | A | 4/1938 | Agosta et al. | 36/8.3 |
| 2,114,790 | A | 4/1938 | Venables | 272/57 |
| 2,138,823 | A | 12/1938 | Werkman | 36/76 |
| 2,165,581 | A | 7/1939 | Schroeder | 36/8.3 |
| D117,918 | S | 12/1939 | Brobick | |
| D146,368 | S | 2/1947 | McCaffrey | D34/14 |
| 2,422,228 | A | 6/1947 | Ferrar | 280/11.19 |
| 2,466,611 | A | 4/1949 | Nicoletti | 36/36 |
| 2,476,806 | A | 7/1949 | Brandt, Jr. | 36/76 |
| 2,484,935 | A | 10/1949 | De Rooy | 36/72 |
| 2,490,469 | A | 12/1949 | Pittman | 36/76 |
| D161,557 | S | 1/1951 | Walker et al. | D34/14 |
| 2,572,671 | A | 10/1951 | Shaw | 36/8.3 |
| 2,582,551 | A | 1/1952 | Malherbe | 36/36 |
| 2,632,964 | A | 3/1953 | Kriegel | 36/37 |
| 2,669,038 | A | 2/1954 | De Werth | 36/38 |
| 2,721,400 | A | 10/1955 | Israel | 36/8.5 |
| 2,723,467 | A | 11/1955 | Cassidy | 36/8.3 |
| 2,897,609 | A | 8/1959 | Bodkin | 36/1 |
| 3,010,732 | A | 11/1961 | Correll | 280/11.24 |
| 3,027,661 | A | 4/1962 | McCord | 36/30 |
| 3,032,894 | A | 5/1962 | Kennedy et al. | 36/1 |
| 3,112,119 | A | 11/1963 | Sweet | 280/11.2 |
| 3,176,416 | A | 4/1965 | Seegert | 36/7.1 |
| 3,306,623 | A * | 2/1967 | Weitzner | 280/11.206 |
| 3,351,353 | A | 11/1967 | Weitzner | 280/7.13 |
| 3,374,002 | A | 3/1968 | Lewis | 280/11.24 |
| 3,476,399 | A | 11/1969 | Finn | 280/11.25 |
| 3,478,447 | A | 11/1969 | Gillead | 36/36 |
| 3,486,250 | A | 12/1969 | Purtle | 36/72 |
| 3,665,621 | A | 5/1972 | Massella | 36/37 |
| 3,789,523 | A | 2/1974 | Rubin | 36/2.5 AH |
| D231,999 | S | 7/1974 | Engman | D34/14 C |
| D233,619 | S | 11/1974 | Kelling | D21/2 |
| 3,876,217 | A | 4/1975 | Copier | 280/11.23 |
| 3,884,485 | A | 5/1975 | Wälle | 280/11.1 R |
| 3,934,359 | A | 1/1976 | Fletcher | 36/73 |
| 3,963,251 | A | 6/1976 | Miano | 280/11.1 BR |
| 3,983,643 | A | 10/1976 | Schreyer et al. | 36/115 |
| 3,997,179 | A | 12/1976 | de Blois | 280/11.24 |
| 4,088,334 | A | 5/1978 | Johnson | 280/11.2 |
| 4,095,817 | A | 6/1978 | Cohen | 280/87.04 A |
| D250,492 | S | 12/1978 | Kish | D34/15 AJ |
| 4,133,548 | A | 1/1979 | Smith | 280/87.04 R |
| 4,138,127 | A | 2/1979 | Kimmell et al. | 280/11.23 |
| 4,149,735 | A | 4/1979 | Blackburn et al. | 280/87.04 A |
| 4,150,497 | A | 4/1979 | Weber | 35/11 R |
| 4,183,547 | A | 1/1980 | Cohen et al. | 280/87.04 A |
| 4,214,384 | A | 7/1980 | Gonzalez R. | 36/42 |
| 4,219,240 | A | 8/1980 | Brandenstein et al. | 301/5.7 |
| 4,223,457 | A | 9/1980 | Borgeas | 36/35 B |
| 4,245,406 | A | 1/1981 | Landay et al. | 36/14 |
| 4,295,655 | A | 10/1981 | Landay et al. | 280/11.2 |
| 4,303,253 | A | 12/1981 | Rottenkolber | 280/11.27 |
| 4,316,334 | A | 2/1982 | Hunt | 36/91 |
| 4,333,249 | A | 6/1982 | Schaefer | 36/115 |
| 4,364,187 | A | 12/1982 | Melendez | 36/15 |
| 4,417,737 | A | 11/1983 | Suroff | 280/11.115 |
| 4,442,614 | A | 4/1984 | Farberov | 36/103 |
| 4,492,046 | A | 1/1985 | Kosova | 36/27 |
| 4,496,025 | A | 1/1985 | Gattman | 182/121 |
| 4,523,767 | A | 6/1985 | Le Page | 280/11.19 |
| 4,638,575 | A | 1/1987 | Illustrato | 36/38 |
| 4,676,010 | A | 6/1987 | Cheskin | 36/32 R |
| 4,691,453 | A | 9/1987 | Tifre | 36/8.3 |
| 4,699,390 | A | 10/1987 | Cote | 280/11.23 |
| 4,763,909 | A | 8/1988 | Bergeron | 280/11.25 |
| 4,783,910 | A | 11/1988 | Boys, II et al. | 36/107 |
| 4,795,181 | A | 1/1989 | Armstrong | 280/87.04 A |
| 4,815,221 | A | 3/1989 | Diaz | 36/27 |
| 4,817,974 | A | 4/1989 | Bergeron | 280/11.2 |
| 4,841,648 | A | 6/1989 | Shaffer et al. | 36/43 |
| 4,843,737 | A | 7/1989 | Vorderer | 36/38 |
| 4,843,741 | A | 7/1989 | Yung-Mao | 36/114 |
| D302,994 | S | 8/1989 | Hawkes et al. | D21/227 |
| 4,887,824 | A | 12/1989 | Zatlin | 280/87.042 |
| 4,897,939 | A | 2/1990 | Harrington | 36/108 |
| 4,928,982 | A | 5/1990 | Logan | 280/11.22 |
| 4,947,560 | A | 8/1990 | Fuerst et al. | 36/88 |
| 4,977,691 | A | 12/1990 | Orchard, 3rd | 36/44 |
| 4,988,122 | A | 1/1991 | Saunders | 280/841 |
| 5,005,300 | A | 4/1991 | Diaz et al. | 36/114 |
| 5,056,240 | A | 10/1991 | Sherrill | 36/7.3 |
| 5,060,401 | A | 10/1991 | Whatley | 36/25 R |
| 5,134,791 | A | 8/1992 | Gregory | 36/107 |
| 5,195,257 | A | 3/1993 | Holcomb et al. | 36/28 |
| 5,224,278 | A | 7/1993 | Jeon | 36/29 |
| 5,236,224 | A | 8/1993 | Anderson et al. | 280/825 |
| 5,249,376 | A | 10/1993 | Capria | 36/115 |
| D341,179 | S | 11/1993 | Evans, III | D21/226 |
| 5,282,325 | A | 2/1994 | Beyl | 36/27 |
| 5,286,043 | A | 2/1994 | Tkaczyk | 280/11.22 |
| 5,319,866 | A | 6/1994 | Foley et al. | 36/91 |
| 5,319,869 | A | 6/1994 | McDonald et al. | 36/114 |
| D352,818 | S | 11/1994 | Bailey | D2/919 |
| 5,363,570 | A | 11/1994 | Allen et al. | 36/28 |
| 5,372,383 | A | 12/1994 | Kubierschky | 280/842 |
| 5,373,649 | A | 12/1994 | Choi | 36/42 |
| 5,381,608 | A | 1/1995 | Claveria | 36/35 R |
| 5,384,973 | A | 1/1995 | Lyden | 36/25 R |
| 5,388,350 | A | 2/1995 | Parker, Jr. | 36/115 |
| 5,392,537 | A | 2/1995 | Goldberg | 36/134 |
| 5,393,077 | A | 2/1995 | Wanous | 280/7.13 |
| 5,396,675 | A | 3/1995 | Vincent et al. | 12/142 P |
| 5,398,970 | A * | 3/1995 | Tucky | 280/841 |
| 5,410,821 | A | 5/1995 | Hilgendorf | 36/100 |
| 5,417,444 | A | 5/1995 | Chen | 280/87.042 |
| 5,419,060 | A | 5/1995 | Choi | 36/36 R |
| 5,425,186 | A | 6/1995 | Hoyt | 36/97 |
| 5,502,901 | A | 4/1996 | Brown | 36/28 |
| 5,511,824 | A * | 4/1996 | Kim | 280/841 |
| 5,519,950 | A | 5/1996 | Wang | 36/42 |
| 5,527,049 | A | 6/1996 | Ortiz | 280/11.2 |
| 5,527,050 | A | 6/1996 | Szendel | 280/11.22 |
| 5,544,431 | A | 8/1996 | Dixon | 36/38 |
| D373,674 | S | 9/1996 | Dolinsky | D2/956 |
| 5,572,804 | A | 11/1996 | Skaja et al. | 36/29 |
| 5,595,004 | A | 1/1997 | Lyden et al. | 36/29 |
| 5,632,104 | A | 5/1997 | Zohar | 36/88 |
| 5,638,614 | A | 6/1997 | Hardy | 36/113 |
| 5,649,374 | A | 7/1997 | Chou | 36/27 |
| 5,655,316 | A | 8/1997 | Huang | 36/132 |
| 5,682,685 | A | 11/1997 | Terlizzi | 36/8.3 |
| 5,692,322 | A | 12/1997 | Lombardino | 36/100 |
| 5,697,643 | A | 12/1997 | Marasco et al. | 280/825 |
| 5,716,074 | A | 2/1998 | Theodorou | 280/843 |

| | | | | |
|---|---|---|---|---|
| 5,716,723 | A | 2/1998 | Van Cleef et al. | 428/690 |
| 5,730,467 | A | 3/1998 | Huang | 280/843 |
| 5,743,028 | A | 4/1998 | Lombardino | 36/27 |
| 5,769,432 | A | 6/1998 | Tybinkowski et al. | 280/11.2 |
| 5,785,327 | A | 7/1998 | Gallant | 280/11.27 |
| 5,797,609 | A | 8/1998 | Fichepain | 280/11.19 |
| 5,823,913 | A | 10/1998 | Aruin et al. | 482/4 |
| 5,836,591 | A | 11/1998 | Roderick et al. | 280/11.22 |
| 5,839,737 | A | 11/1998 | Kruczek | 280/11.115 |
| D401,739 | S | 12/1998 | James | D2/946 |
| D402,797 | S | 12/1998 | Kracke | D2/948 |
| D404,550 | S | 1/1999 | James | D2/960 |
| 5,881,413 | A | 3/1999 | Throneburg et al. | 12/133 B |
| 5,882,018 | A | 3/1999 | Petrosino | 280/7.13 |
| 5,885,500 | A | 3/1999 | Tawney et al. | 264/154 |
| 5,887,898 | A | 3/1999 | Petrosino | 280/825 |
| D408,123 | S | 4/1999 | James | D2/969 |
| 5,927,729 | A | 7/1999 | Di Filippo et al. | 280/11.3 |
| 5,927,734 | A | 7/1999 | Horton, II et al. | 280/87.042 |
| D412,778 | S | 8/1999 | James | D2/951 |
| D412,779 | S | 8/1999 | James | D2/957 |
| D413,193 | S | 8/1999 | James | D2/947 |
| 5,930,918 | A | 8/1999 | Healy et al. | 36/29 |
| D414,021 | S | 9/1999 | James | D2/951 |
| D414,320 | S | 9/1999 | Brent | D2/969 |
| 5,951,049 | A | 9/1999 | Calverey et al. | 280/825 |
| 5,967,552 | A | 10/1999 | Roderick et al. | 280/843 |
| 5,970,631 | A | 10/1999 | Inman | 36/115 |
| 5,979,992 | A | 11/1999 | Calderone et al. | 301/5.3 |
| 5,988,656 | A | 11/1999 | Krah | 280/11.27 |
| 5,997,105 | A | 12/1999 | Wu | 301/124.1 |
| 6,006,449 | A | 12/1999 | Orlowski et al. | 36/27 |
| 6,006,450 | A | 12/1999 | Hayes | 36/107 |
| 6,006,451 | A | 12/1999 | Morris et al. | 36/115 |
| D420,789 | S | 2/2000 | James | D2/962 |
| 6,041,525 | A | 3/2000 | Kelley | 36/115 |
| 6,050,357 | A | 4/2000 | Staelin et al. | 180/65.1 |
| 6,055,747 | A | 5/2000 | Lombardino | 36/37 |
| 6,061,930 | A | 5/2000 | Zinovieff | 36/115 |
| D426,374 | S | 6/2000 | Kelley | D2/968 |
| D426,948 | S | 6/2000 | James | D2/968 |
| 6,070,887 | A | 6/2000 | Cornelius et al. | 280/11.27 |
| 6,092,305 | A | 7/2000 | Troy et al. | 36/3 B |
| 6,115,943 | A | 9/2000 | Gyr | 36/35 R |
| 6,115,946 | A | 9/2000 | Morris et al. | 36/115 |
| 6,120,039 | A | 9/2000 | Clementi | 280/11.19 |
| 6,132,006 | A | 10/2000 | Post | 301/5.3 |
| D433,214 | S | 11/2000 | McDowell | D2/957 |
| 6,151,806 | A | 11/2000 | Morris et al. | 36/136 |
| 6,158,150 | A | 12/2000 | Morris et al. | 36/115 |
| 6,170,837 | B1 | 1/2001 | Ross | 280/1 |
| 6,195,918 | B1 | 3/2001 | Kelley et al. | 36/115 |
| 6,195,920 | B1 | 3/2001 | Morris et al. | 36/132 |
| D440,386 | S | 4/2001 | James | D2/968 |
| 6,213,480 | B1 | 4/2001 | Rodriguez | 280/11.204 |
| 6,226,900 | B1 | 5/2001 | Mazars | 36/132 |
| 6,243,972 | B1 | 6/2001 | De France | 36/117.1 |
| 6,247,251 | B1 | 6/2001 | James | 36/115 |
| 6,247,708 | B1 | 6/2001 | Hsu | 280/11.223 |
| 6,250,656 | B1 | 6/2001 | Ibarra | 280/87.041 |
| 6,308,964 | B1 | 10/2001 | Chang | 280/11.19 |
| 6,336,644 | B1 | 1/2002 | Chu | 280/11.233 |
| 6,343,800 | B1 | 2/2002 | Clementi | 280/11.233 |
| 6,354,609 | B1 * | 3/2002 | Chen et al. | 280/11.3 |
| 6,357,145 | B1 | 3/2002 | James | 36/115 |
| 6,386,555 | B1 | 5/2002 | Kao | 280/7.13 |
| 6,406,037 | B1 | 6/2002 | Chang | 280/11.19 |
| 6,406,038 | B1 | 6/2002 | Adams | 280/11.24 |
| 6,406,039 | B1 * | 6/2002 | Chen | 280/11.27 |
| 6,412,791 | B1 | 7/2002 | Chu | 280/11.19 |
| 6,450,509 | B1 | 9/2002 | Adams | 280/11.24 |
| 6,464,236 | B1 | 10/2002 | Chang | 280/11.223 |
| 6,467,198 | B1 | 10/2002 | James | 36/115 |
| 6,488,289 | B1 * | 12/2002 | Hsiao et al. | 280/11.208 |
| 6,523,836 | B1 | 2/2003 | Chang et al. | 280/11.223 |
| 6,536,785 | B1 | 3/2003 | Lee | 280/11.27 |
| 6,572,120 | B1 | 6/2003 | Chang | 280/11.233 |
| 6,581,943 | B1 * | 6/2003 | Wegener | 280/11.221 |
| 6,629,698 | B1 | 10/2003 | Chu | 280/11.19 |
| 6,698,769 | B1 | 3/2004 | Adams et al. | 280/11.233 |
| 6,719,304 | B1 | 4/2004 | Miller et al. | 280/11.27 |
| 6,739,602 | B1 | 5/2004 | Adams | 280/11.19 |
| 6,746,026 | B1 | 6/2004 | Adams | 280/11.19 |
| 6,751,891 | B1 | 6/2004 | Lombardino | 36/28 |
| 6,764,082 | B1 | 7/2004 | Roderick | 280/11.223 |
| 6,805,363 | B1 * | 10/2004 | Hernandez | 280/11.19 |
| 6,848,201 | B1 | 2/2005 | Staffaroni et al. | 36/35 B |
| 6,926,289 | B1 | 8/2005 | Wang | 280/7.13 |
| 6,979,003 | B1 | 12/2005 | Adams | 280/11.19 |
| 7,032,330 | B1 | 4/2006 | Adams et al. | 36/115 |
| 7,063,336 | B1 * | 6/2006 | Adams | 280/11.221 |
| 2002/0060435 | A1 | 5/2002 | Kim | |
| 2002/0070511 | A1 | 6/2002 | Adams | |
| 2002/0105153 | A1 * | 8/2002 | Miller | 280/11.231 |
| 2002/0125655 | A1 * | 9/2002 | Hsiao | 280/11.19 |
| 2002/0130475 | A1 | 9/2002 | Adams | |
| 2003/0141680 | A1 * | 7/2003 | Clark et al. | 280/11.27 |
| 2004/0239056 | A1 | 12/2004 | Cho et al. | |
| 2006/0022417 | A1 | 2/2006 | Roderick | |

FOREIGN PATENT DOCUMENTS

| | | | | |
|---|---|---|---|---|
| DE | 254775 | | 5/1912 | |
| DE | 309567 | A | 10/1918 | 280/11.227 |
| DE | 456796 | | 3/1928 | 280/843 |
| DE | 723266 | | 8/1942 | |
| DE | 821323 | | 7/1949 | |
| DE | 204456 | | 12/1958 | |
| DE | 2321669 | | 3/1974 | |
| DE | 2550211 | A1 | 5/1976 | |
| DE | 2821644 | A1 | 5/1978 | |
| DE | 29613508 | U1 | 10/1996 | |
| DE | 197 55 340 | | 6/1999 | |
| DE | 20012020 | U1 | 11/2000 | |
| DE | 20023053.0 | | 10/2002 | |
| FR | 1194886 | A | 11/1959 | |
| FR | 2196826 | | 3/1974 | |
| FR | 2291715 | | 6/1976 | |
| GB | 2297 | | 6/1877 | 280/11.24 |
| GB | 117176 | | 7/1918 | |
| GB | 150512 | A | 9/1920 | |
| GB | 216903 | A | 1/1925 | |
| GB | 2363562 | | 3/2000 | |
| IT | 666436 | | 8/1964 | |
| JP | 6417 | | 8/1907 | |
| JP | 17-3781 | | 3/1942 | |
| JP | 24-4902 | | 12/1949 | |
| JP | 50-139077 | | 11/1975 | |
| JP | 56-1685 | | 1/1981 | |
| JP | 57-145459 | | 9/1982 | |
| JP | 58-30474 | | 2/1983 | |
| JP | 58-142078 | | 9/1983 | |
| JP | 59-55574 | | 4/1984 | |
| JP | 61-94621 | | 6/1986 | |
| JP | 63-135673 | | 9/1988 | |
| JP | 2-82903 | | 6/1990 | |
| JP | 5-40721 | | 10/1993 | |
| JP | 7-79804 | | 3/1995 | |
| JP | 9-508826 | | 9/1997 | |
| JP | 10-509059 | | 9/1998 | |
| KR | 90-11303 | | 3/1988 | |
| KR | 20-0325185 | | 8/2003 | |
| KR | 20-0364789 | | 10/2004 | |
| KR | 20-0369807 | | 11/2004 | |
| KR | 20-0378100 | | 2/2005 | |
| KR | 20-0398724 | | 10/2005 | |

| | | |
|---|---|---|
| KR | 10-0572144 | 4/2006 |
| KR | 10-0572145 | 4/2006 |
| WO | WO 92/05845 | 4/1992 |
| WO | WO 95/20424 | 8/1995 |
| WO | WO 96/40393 | 12/1996 |
| WO | WO 98/01051 | 1/1998 |
| WO | WO 02/11831 A1 | 2/2002 |

OTHER PUBLICATIONS

Advertisement for "Street Flyers" at the Internet website for FAO Schwartz, www.fao.com/faoschwarz/streetflyers.html dated Dec. 17, 1999.

Advertisement for "Street Flyers" at the Internet website for StreetFlyers, www.streetflyers.com/cgi-bin/ncommerce3/ExecMacro/home.d2w/report dated Jan. 24, 2000.

Advertisement on eBay: "Wheelyz-Like Heelys Blue Skate Shoe" located at internet website: http://cgi.ebay.com/Wheelyz-Like-Heelys-Blue-Skate-Shoe_W0QQitemZ7173785832QQcategoryZ22704... dated Aug. 4, 2005, 6 pgs.

* cited by examiner

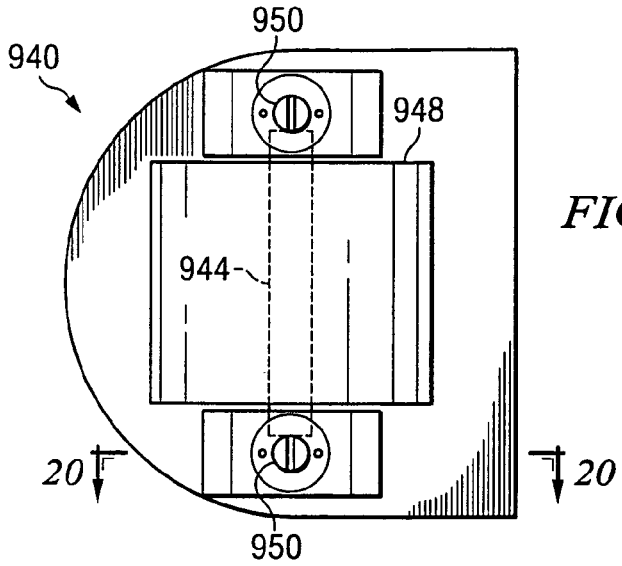
FIG. 19
FIG. 20
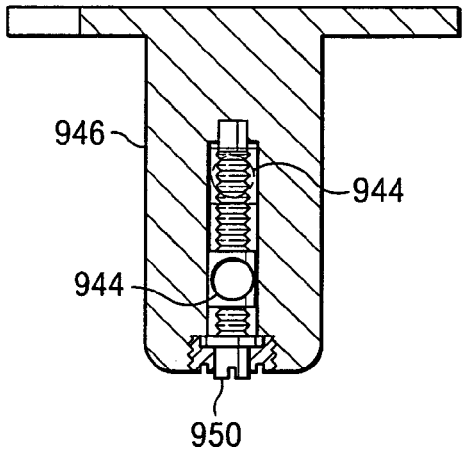
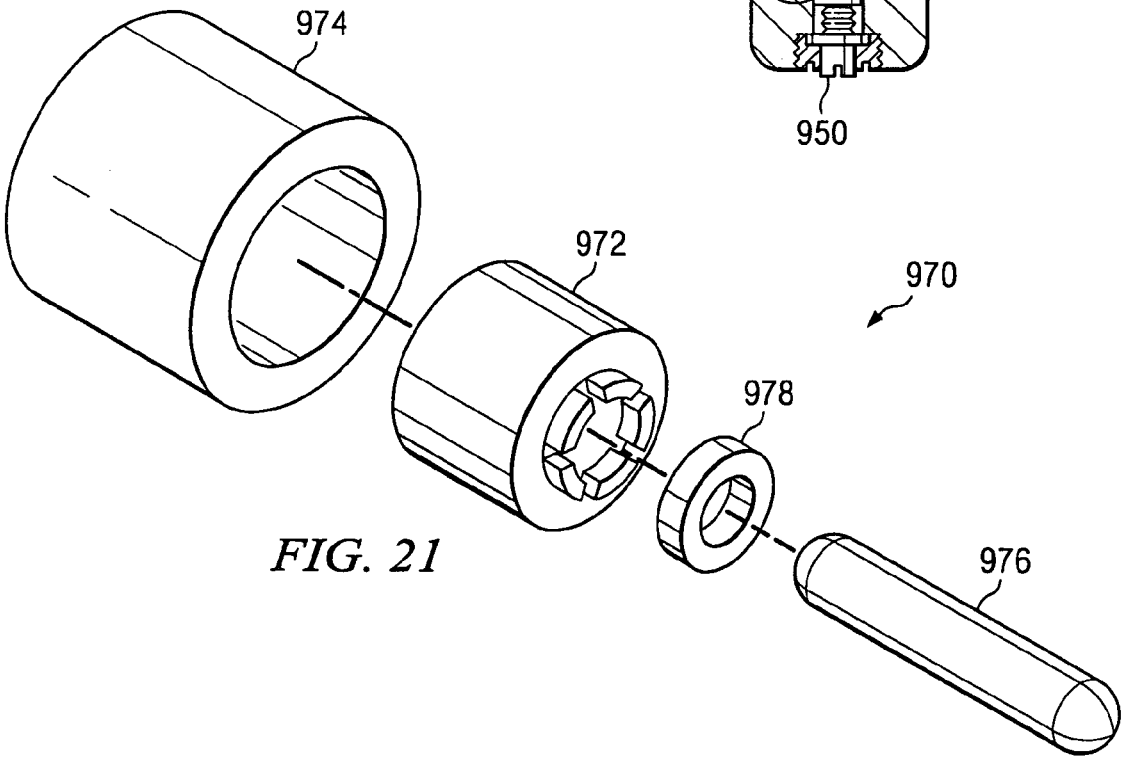
FIG. 21

EXTERNAL WHEELED HEELING APPARATUS AND METHOD

CROSS-REFERENCE TO RELATED APPLICATIONS

Pursuant to 35 U.S.C. § 120, this continuation application claims priority from, and hereby incorporates by reference for all purposes, U.S. patent application Ser. No. 10/369,063, entitled External Wheeled Heeling Apparatus and Method naming Roger R. Adams as inventor, filed Feb. 18, 2003, now U.S. Pat. No. 7,063,336 which pursuant to 35 U.S.C. § 120 claims priority from, and hereby incorporates by reference for all purposes, copending U.S. patent application Ser. No. 10/077,895, entitled Heeling Apparatus and Method, naming Roger R. Adams as inventor, filed Feb. 18, 2002, which claims priority to issued U.S. Pat. No. 6,450,509, entitled Heeling Apparatus and Method, naming Roger R. Adams as inventor, filed Mar. 31, 2000, issued Sep. 17, 2002, which, pursuant to 35 U.S.C. § 119(e), claims the benefit of U.S. Provisional Patent Application Ser. No. 60/127,459, entitled Heeling Apparatus and Method, naming Roger R. Adams as inventor, filed Apr. 1, 1999, and further pursuant to 35 U.S.C. § 119(e), this application claims the benefit of U.S. Provisional Patent Application No. 60/358,908, entitled External Wheeled Heeling Apparatus and Method, filed Feb. 22, 2002, naming Roger R. Adams as inventor, which is also incorporated herein by reference for all purposes.

TECHNICAL FIELD OF THE INVENTION

This invention relates in general to the field of footwear active sports and more particularly to an external wheeled heeling apparatus and method.

BACKGROUND OF THE INVENTION

Active footwear with a wheel in the heel was invented by the inventor of the present application. However, some individuals desire more control, functionality and versatility than provided by a standard heeling apparatus. For this reason, an improved heeling apparatus is needed for those more aggressive heelers to achieve their desired level of heeling.

For this reason, a need exists for an improved heeling apparatus that provides the heeler with additional capabilities.

SUMMARY OF THE INVENTION

From the foregoing it may be appreciated that a need has arisen for an external wheeled heeling apparatus and method for advanced heeling.

According to an aspect of the present invention a footwear operable for rolling is provided. The footwear has a sole having a heel portion and at least two wheels rotatably mounted on an axle. The axle is at least partially retained by the sole such that the at least two wheels operably rotate beside an outer peripheral edge of the heel portion of the sole of the footwear.

According to another aspect of the present invention a footwear operable for rolling is provided. The footwear has a sole having a heel portion and at least a first and second wheel rotatably mounted on an axle. The axle positioned such that the first wheel is positioned adjacent a first side of the heel portion of the sole and such that the second wheel is positioned adjacent a second side of the heel portion of the sole. In one aspect, the second wheel is positioned adjacent an oppositely disposed second side of the heel portion of the sole.

In yet another aspect of the present invention, a footwear operable for rolling is provided. The footwear has a sole having a heel portion and at least a first and second wheel rotatably mounted on an axle. A portion of the axle extending through the sole of the footwear such that the first wheel is positioned adjacent a first side of the heel portion of the sole and such that the second wheel is positioned adjacent a second side of the heel portion of the sole. In one aspect, a first wheel is rotatably mounted on a first axle and a second wheel is rotatably mounted on a second axle. A portion of the first axle connected to the sole adjacent the first side of the heel portion of the sole and a portion of the second axle connected to the sole adjacent the second side of the heel portion of the sole.

In one aspect the present invention further provides a suspension mechanism connected to the axle, or in the two axle aspect, a first and second suspension mechanism connected to the first and second axle, respectively. The suspension mechanism operable to absorb shock and promote engagement with a surface of the wheel rotatably mounted on the axle.

In yet another aspect, the axle is coupled such that the first and second wheel are disposed under at least a portion of the heel portion of the sole of the footwear. In other aspects, the a first portion of the first and second wheels are disposed under at least a portion of the heel portion of the sole of the footwear and a second portion of the first and second wheels extend laterally a distance from the heel portion of the sole of the footwear.

In another aspect, the axle extends from the sole such that the first and second wheels are positioned adjacent an outer peripheral edge of the heel portion of the sole. In other aspects, the wheels are positioned a distance from the outer peripheral edge of the heel portion of the sole of the footwear.

In one aspect, wheels are removable from the axle. In another aspect, the wheels are provided with a locking mechanism operable to prevent rotation on the axle when the locking mechanism is in a locked position. In other aspects the external wheeled heeling apparatus is provided with a grind plate positioned adjacent at least a portion of an arch portion of the sole of the footwear.

In one aspect the present invention provides a method for heeling including providing an external wheeled heeling apparatus including a footwear having a sole. The footwear having a first and second wheel rotatably mounted on an axle. A first end of the axle extending from a first outer peripheral edge of a heel portion of the sole of the footwear and the second end of the axle extending from a second outer peripheral edge of the heel portion of the sole of the footwear such that the first wheel operably rotates beside the first outer peripheral edge of the heel portion of the sole and such that the second wheel operably rotates beside the second outer peripheral edge of the heel portion of the sole.

In other aspects, the present invention provides an external wheeled heeling apparatus for walking and running and transitioning to rolling on a surface. The external wheeled heeling apparatus includes a sole, a first and second wheels. The sole has a forefoot, an arch and a heel portion provided with a first side of the heel portion and a second side of the heel portion.

The forefoot is operable to engage the surface for walking and running. The first wheel is operably coupled to rotate adjacent the first side of the heel portion. The second wheel operably coupled to rotate adjacent the second side of the heel portion.

In another aspect, the present invention provides a method of transitioning from a stationary state to a rolling state on a surface. The method includes contacting at least a portion of a forefoot of a footwear on a surface to inhibit rolling. A sole of the footwear having a heel portion having a first outer side and a second outer side. Te sole further having an arch portion The method provides for elevating the forefoot of the sole of the footwear relative to the surface such that either none or an insubstantial portion of a user's weight is supported by the forefoot. The method includes rolling on the surface using a first wheel operable to rotate adjacent the first outer side of the heel portion of the sole and using a second wheel operable to rotate adjacent a second outer side of the heel portion of the sole while supporting at least a portion of the user's weight.

Other technical advantages are readily apparent to one skilled in the art from the following figures, description, and claims.

BRIEF DESCRIPTION OF THE DRAWINGS

For a more complete understanding of the present invention and the advantages thereof, reference is now made to the following brief description, taken in connection with the accompanying drawings and detailed description, wherein like reference numerals represent like parts, in which:

FIG. 19 is a bottom view that illustrates the wheel assembly of FIG. 18 that further illustrates the dual king pin arrangement;

FIG. 20 is a side view that illustrates one member of the mounting structure that further illustrates the coupling of the axle to the mounting structure using the dual king pin arrangement;

FIG. 21 is a breakaway and perspective view that illustrates a two piece wheel that includes an inner core and an outer tire and that may be used in the present invention;

DETAILED DESCRIPTION OF THE INVENTION

It should be understood at the outset that although an exemplary implementation of the present invention is illustrated below, the present invention may be implemented using any number of techniques, materials, designs, and configurations whether currently known or in existence. The present invention should in no way be limited to the exemplary implementations, drawings, and techniques illustrated below, including the exemplary designs and implementations illustrated and described herein.

FIGS. 1–21 illustrate various aspects of a heeling apparatus and method as exemplary athletic footwear that may be configured, modified or employed utilizing an external wheeled heeling apparatus, according to one or more aspects of the present invention. It should be appreciated, however, that the present invention is not limited to the construction, configuration and implementations of the heeling apparatus illustrated in FIGS. 1–21 and may be utilized on any footwear or with additional or different components or configuration which are within the spirit and scope of the present invention.

Figure 1:
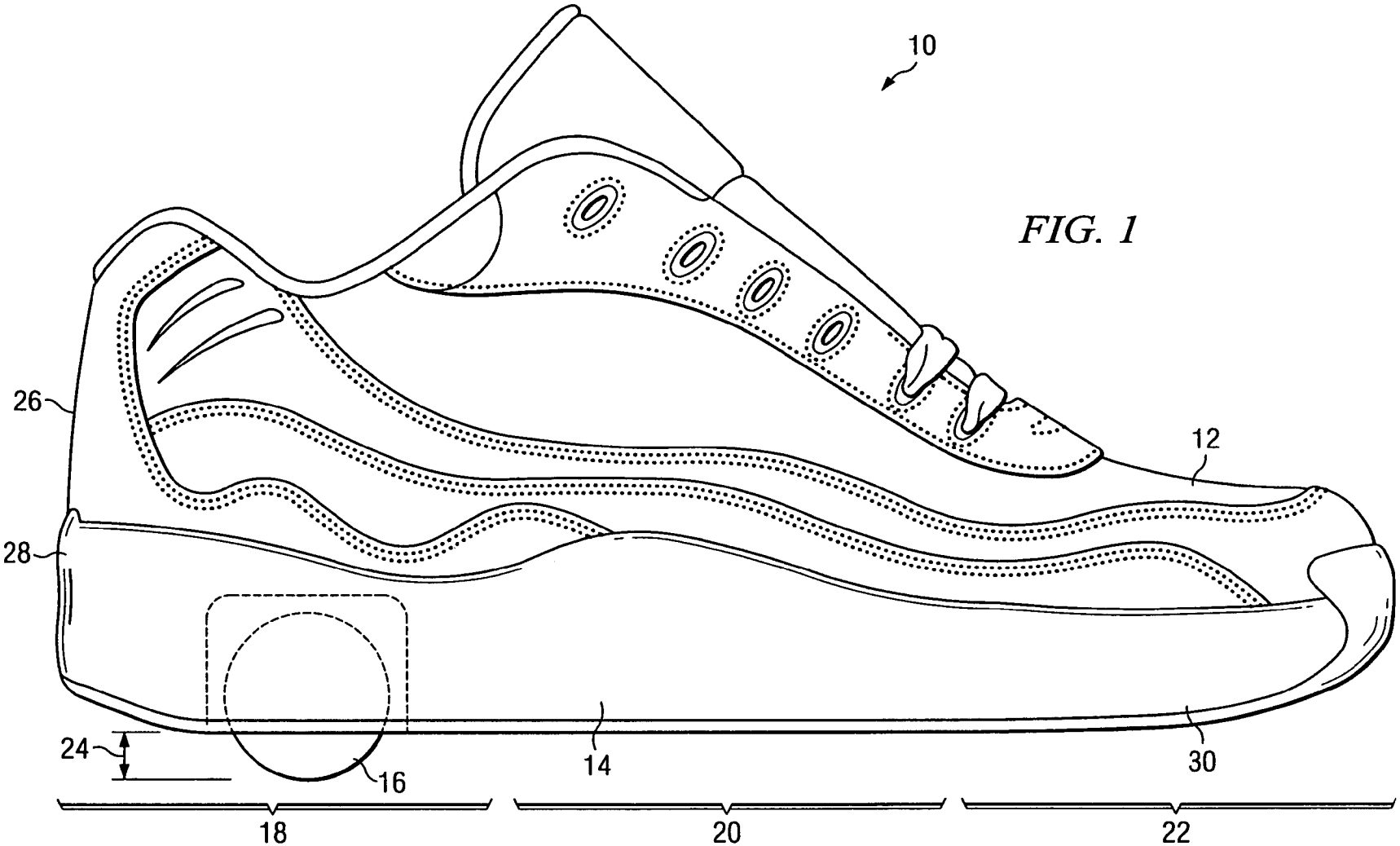
FIG. 1 is a side view that illustrates a heeling apparatus implemented using an athletic shoe according to one embodiment of the present invention.

FIG. 1 is a side view of a heeling apparatus 10 implemented using an athletic shoe 12 according to one embodiment of the present invention. The heeling apparatus 10 preferably includes a wheel assembly provided in an opening in the heel portion of the sole of a footwear. For example the athletic shoe 12 includes an opening in the bottom of a heel portion 18 of a sole 14 with a wheel assembly provided in the hole such that a wheel 16 extends below the bottom of the sole 14. The wheel assembly preferably includes at least one wheel, such as the wheel 16, rotatably mounted on an axle (not illustrated in FIG. 1). The wheel 16 mounted on the axle is preferably positioned in the opening of the sole 14 through a mounting structure (not illustrated in FIG. 1) that is operable to support the axle such that a portion of the wheel 16 extends below the heel portion 18 of the sole 14.

The amount or length of the portion of the wheel 16 that extends below the bottom of the sole 14, as defined by a distance 24, will preferably be less than the diameter of the wheel 16. The distance 24, however, may be greater than, less than, or equal to the diameter of the wheel 16.

The athletic shoe 12, as is true of most footwear, may be generally described as having the sole 14 and an upper part 26. The upper part 26 may be constructed of virtually any material such as, for example, leather, plastic, or canvas. The sole 14 may include three parts: (1) an inner sole or insole (not illustrated in FIG. 1); (2) a midsole 28; and (3) an outer sole or outsole 30. The insole may provide added cushion and may or may not be removable. In some embodiments, the insole may include a removable portion, such as a DR. SCHOLL'S insole, and a portion that remains attached to the athletic shoe 12. The outsole 30 will preferably be made of a durable material, such as rubber, and may have a textured surface, such as with knobbies, to provide added traction. The midsole 28 will generally be constructed of a soft or "cushiony" material and will generally be thicker than the insole and the outsole 30. In some embodiments, however, the sole 14 will comprise only one part, such as the leather sole of a loafer. In other embodiments, the sole 14 may include a separate heel block or object that elevates the footwear, such as the heel of a leather wingtip dress shoe. This heel block or object may be considered to be part of the heel portion 18 of the sole 14. It should be understood that the present invention may be implemented in virtually any footwear, irrespective of the design or the make-up of the sole 14. Various styles of footwear and methods of making footwear are known in the art and are known by one of ordinary skill in the art. For example, U.S. Pat. Nos. 4,245,406, 5,319,869, 5,384,973, 5,396,675, 5,572,804, 5,595,004, and 5,885,500, which are hereby incorporated by reference for all purposes, provide various background information regarding various footwear and methods of making footwear.

In most footwear, including the athletic shoe 12, the sole 14 may also be divided into three portions or regions: (1) the heel portion 18, (2) an arch portion 20, and (3) a forefoot portion 22, as illustrated in FIG. 1. It should be understood that the heel portion 18, the arch portion 20, and the forefoot portion 22 of the sole 14 are incapable of being exactly defined and located, and that such portions vary from one footwear type to another. Thus, the location, the boundaries between, and the size of the heel portion 18, the arch portion 20, and the forefoot portion 22 of the sole 14 are only rough approximations.

It should also be understood that although the position of the opening in the bottom of the sole 14, and hence also the wheel 16, is preferably located in the heel portion 18 of the sole 14, such an opening may also be located at the boundary of the heel portion 18 and the arch portion 20, at the arch portion 20, or at virtually any other location on the sole 14. The opening in the bottom of the sole 14 may extend entirely through the sole 14, e.g., through the outsole, the midsole and the insole, or only partially through the sole 14, e.g., through the outsole, and a portion or all of the midsole.

The wheel 16 may be constructed or made of virtually any known or available material such as, for example, a urethane, a plastic, a polymer, a metal, an alloy, a wood, a rubber, a composite material, and the like. This may include, for example, aluminum, titanium, steel, and a resin. Preferably, the material will be durable, provide quiet performance, and will provide a "soft" or "cushioning" feel. In one embodiment, the wheel 16 may be implemented as one or more precision bearings such that the precision bearing serves as the wheel 16 itself. In yet another embodiment, the wheel assembly may include a spring or suspension such as, for example, a leaf spring, to provide additional cushion or suspension when the wheel 16 contacts a surface and a force is applied to the athletic shoe 12 in the direction of the surface, such as when a someone is wearing and walking in the heeling apparatus 10. The spring is preferably provided as part of the mounting structure of the wheel assembly. In still another embodiment, the wheel 16 is provided as a two piece wheel with an inner core, such as a hard inner core, such as a hard inner core, surrounded by an outer tire, such as a urethane tire.

Depending on the desired implementation, the wheel 16 and the axle may be removable from the wheel assembly. In such a case, a removable cover may be provided in the opening in the sole 14 to cover the opening so that debris and dirt does not enter the opening. The removable cover may be provided in virtually any available configuration readily ascertainable by one of ordinary skill in the art. In one embodiment of the removable cover, an axle portion of the removable cover fits and/or couples to the mounting structure in the same or similar manner that the axle in which the wheel 16 is mounted fits and/or couples to the mounting structure of the wheel assembly. A tool may also be provided to facilitate the removal of the axle and wheel 16. This tool will, preferably, be small and multi-functional to provide any other possible adjustments to the heeling apparatus 10, such as a screw driver, a wrench, and the like. In other embodiments of the heeling apparatus 10, the wheel 16 may be retractable into the opening in the sole 14. In this manner, the wheel 16 may be retracted into the sole 14 and, thus, will not extend below the bottom of the sole 14. This allows the heeling apparatus 10 to function just like ordinary footwear, such as the athletic shoe 12.

Figure 13:
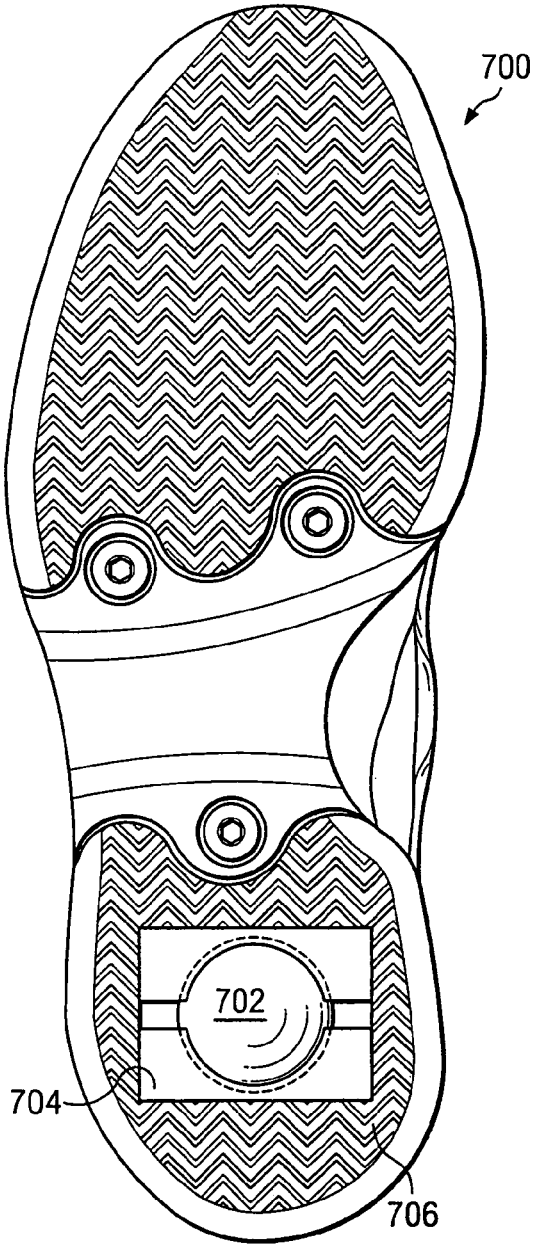
FIG. 13 is a bottom view that illustrates another embodiment of the present invention with a spherical ball serving as a wheel and positioned in a mounting structure in an opening in the heel portion of the sole.

In one embodiment of the present invention, the wheel assembly does not include an axle, and, arguably, not a mounting structure, and the wheel 16 is provided as a sphere, such as a stainless steel ball bearing, that is rotatably positioned in the opening in the bottom of the heel portion 18 of the sole 14, one embodiment of which is shown in FIG. 13. In another embodiment, the wheel assembly comprises an axle positioned completely through or partially through the heel portion 18 of the sole 14 such that the sole 14 supports the axle and the wheel is rotatably mounted on the axle in the opening of the sole 14. In this manner, the need for the mounting structure is eliminated.

Figure 12:
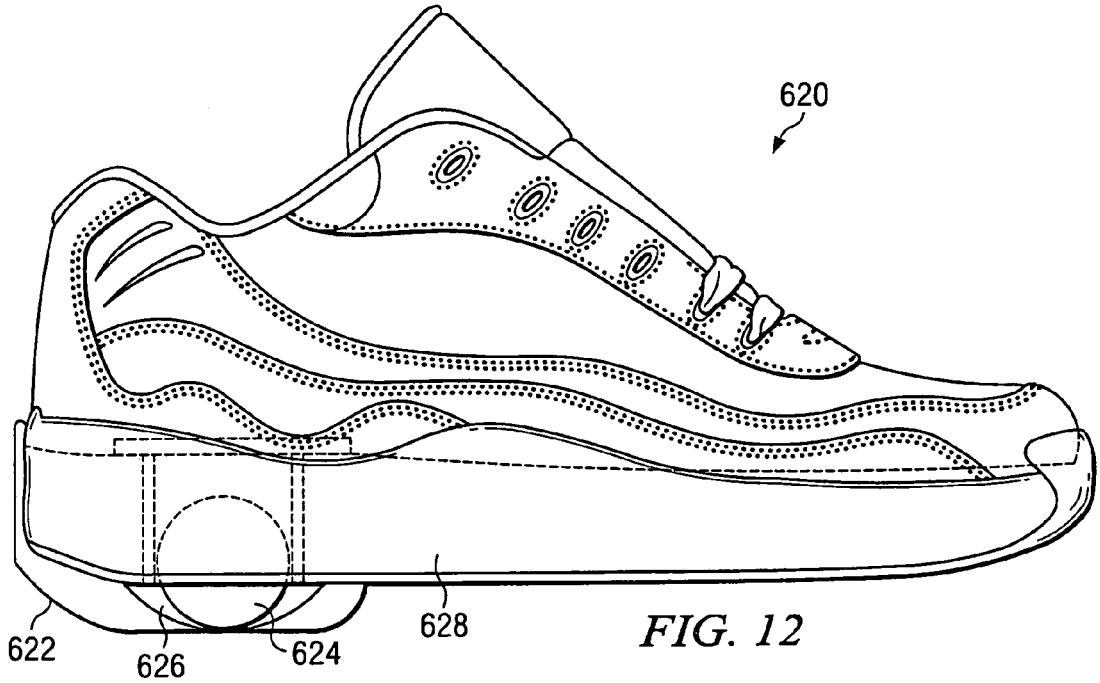
FIG. 12 is a side view of another embodiment that illustrates the heeling apparatus of the present invention with a removable wheel cover positioned to cover the wheel and the opening in the sole.

In operation, a person wearing the heeling apparatus 10 may either walk normally or roll on the wheel 16 by lifting or raising the sole 14 so that only or almost only the wheel 16 contacts a surface. This action may be referred to as "HEELING" or to "HEEL." The wheel 16, depending on the desired implementation of the present invention, may be removed or retracted to a position such that the wheel 16 does not extend below the bottom of the sole 14. This, generally, will result in the heeling apparatus 10 performing like an associated footwear. When the wheel 16 is removed or retracted, a removable cover may be placed over the opening in the bottom of the sole 14 to prevent debris from entering the opening and potentially damaging the wheel assembly. In still other embodiments, a removable cover may be placed over the wheel 16 while a portion of the wheel 16 remains extended below the bottom of the sole 14 to assist with walking, an example of this is illustrated in FIG. 12.

It should be understood, however, that even if the wheel 16 is not removed or retracted as just described, the user may still comfortably walk and run, even with the wheel 16 extended. This generally occurs because the distance 24 can be minimal, which provides a unique "stealth" or "covert" aspect to heeling. This also results in the wheel rolling the opening or hole in the sole 14 of the heeling apparatus 10. In one embodiment, the distance 24 is less than the radius of the wheel 16, which results in most of the wheel residing within the opening of the sole 14.

Figure 2A:
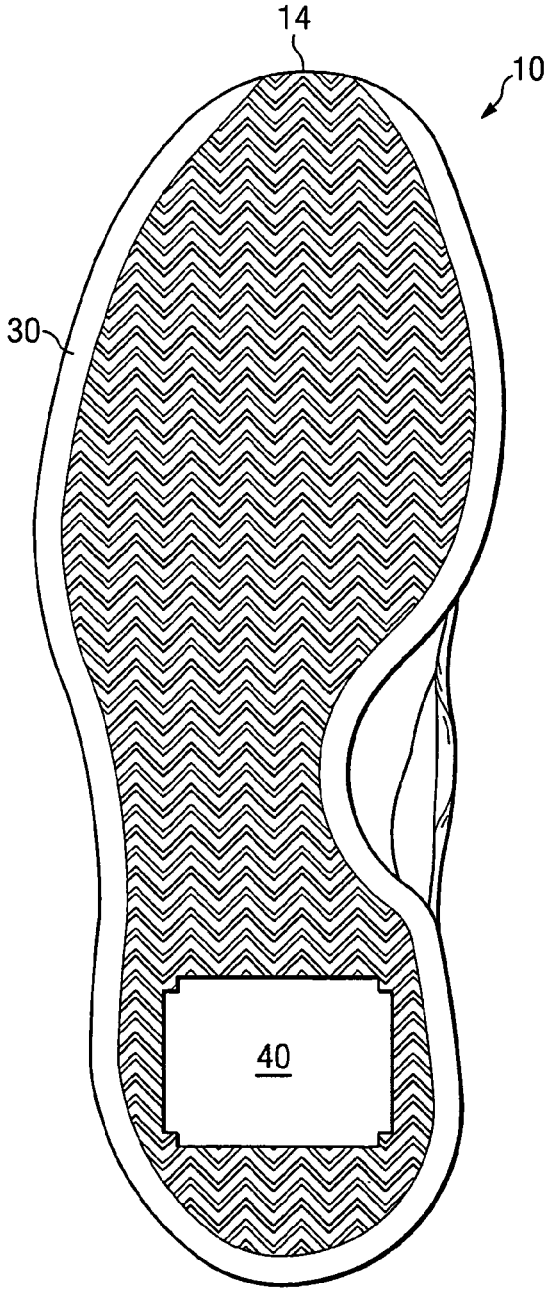
FIGS. 2A and 2B are bottom views that illustrate two embodiments of a sole of the heeling apparatus with openings in the sole.
Figure 2B:
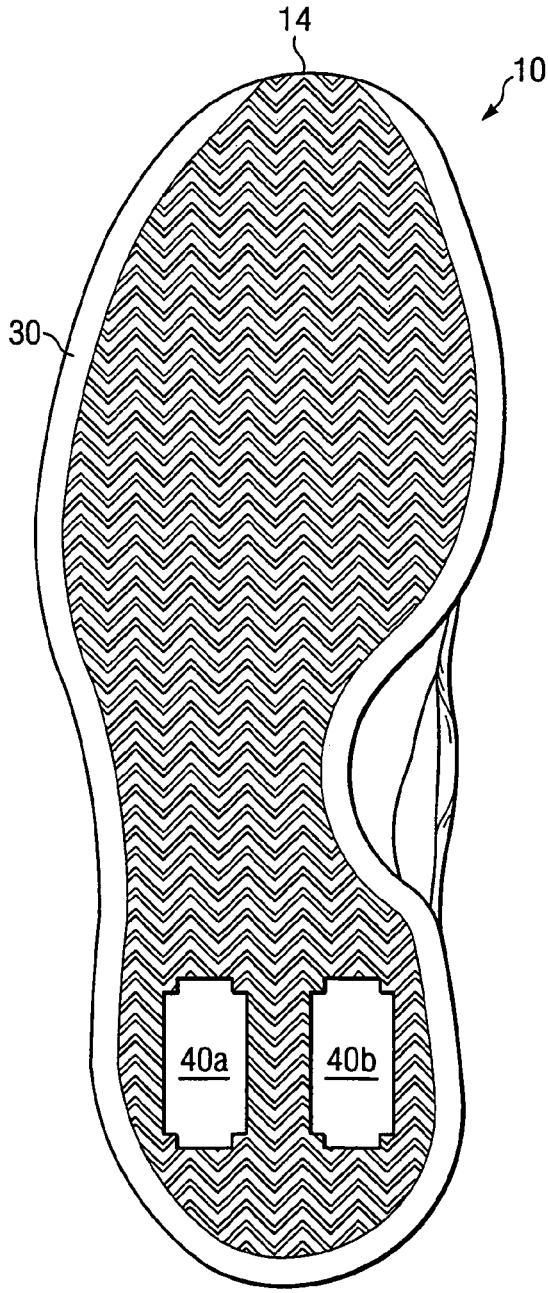

FIGS. 2A and 2B are bottom views of two embodiments of the sole 14 of the heeling apparatus 10. In particular, the outsole 30 or bottom of the sole 14 is illustrated in FIG. 2A with an opening 40 in the heel portion 18 of the sole 14. In the embodiment illustrated, the opening 40 is provided in a square or rectangular configuration. The opening 40, however, may be provided in virtually any configuration, such as, for example, a circular or an elliptical configuration.

As mentioned previously, the opening 40 may extend partially or completely through the sole 14. The opening 40 may be provided through a heel block or object. Further, the opening 40 be positioned in, near, or in a combination of the heel portion 18, the arch portion 20, and the forefoot portion 22.

FIG. 2B illustrates a second embodiment as to the placement and configuration of the opening 40. The outsole 30 is illustrated with an opening 40A and an opening 40B in the heel portion 18 of the sole 14. In this manner, one or more wheels, including one or more axles, may be positioned in both the opening 40A and 40B.

Figure 3A:
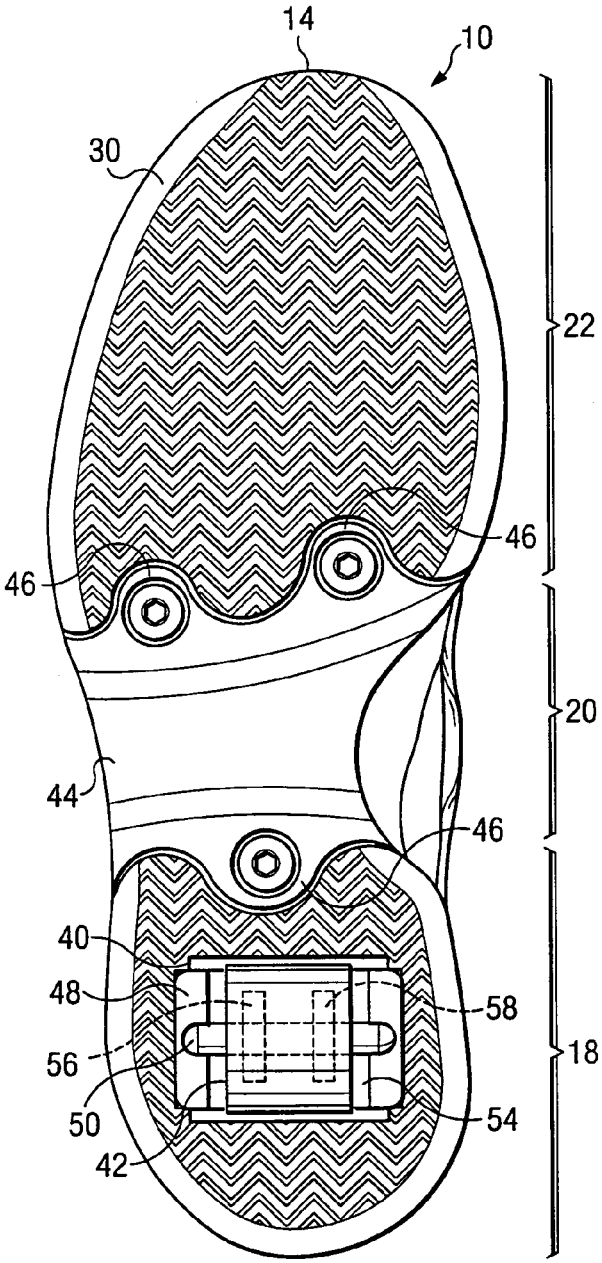
FIGS. 3A and 3B are bottom views of the two embodiments of the sole as shown in FIGS. 2A and 2B and illustrate a wheel in each of the openings of the soles.
Figure 3B:
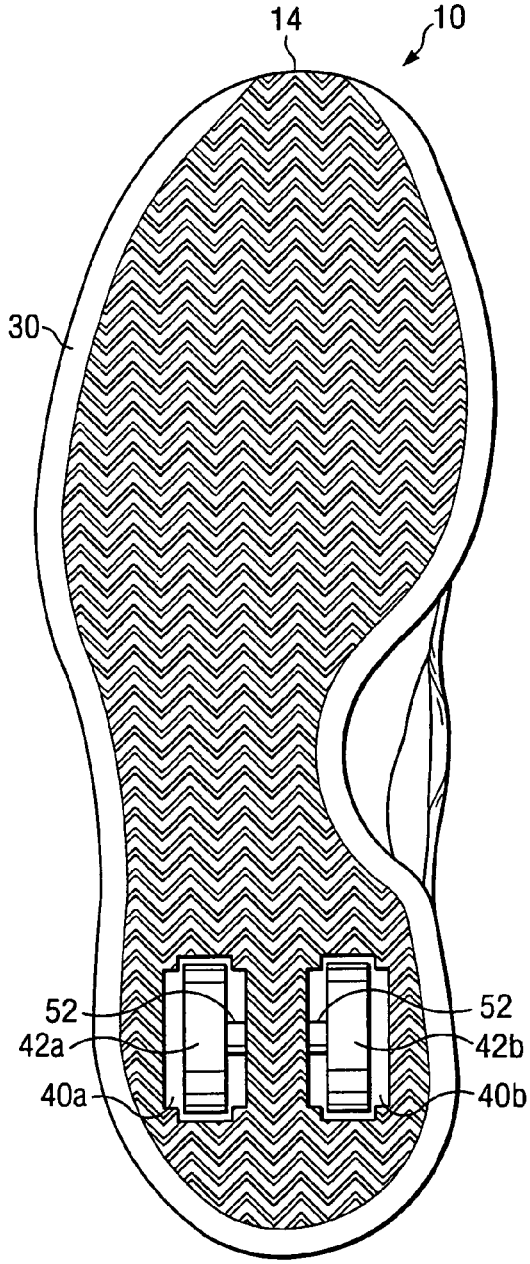

FIGS. 3A and 3B are bottom views of the two embodiments of the sole 14 as shown in FIGS. 2A and 2B and illustrate a wheel in each of the openings of the soles. This includes a wheel 42 positioned in the opening 40 in FIG. 3A and a wheel 42A and a wheel 42B in the openings 40A and 40B, respectively, of FIG. 3B.

The wheel 42 and the wheels 42A and 42B are illustrated as cylindrical wheels. These wheels, however, may be provided in virtually any available configuration. Further, one or more wheels may be positioned in each opening.

FIG. 3A further illustrates other elements of the wheel assembly that include a first member 48 and a second member 54 of a mounting structure that is used to removably couple with an axle 50. The axle 50 extends through the wheel 42 such that the wheel 42 is rotatably coupled or mounted to the axle 50. This preferably involves the use of precision bearings, such as high performance precision bearings, provided in a recess, such as an annular recess, on either side of the wheel 42. A first precision bearing 56 and a second precision bearing 58 may be ABEC grade precision bearings and are illustrated with hidden lines and positioned in the first recess and second recess of the wheel 42. In alternative embodiment, loose ball bearings may be used.

The axle 50 may be made of any material that provides suitable physical characteristics, such as strength and weight, to name a few. The axle 50 is preferably made of hardened steel, is cylindrical in shape, each end is rounded, and is removably coupled with a first member 48 and a second member 54, respectively, of the mounting structure. The removable coupling between each end of the axle 50 and the first member 48 and the second member 54 may be achieved by any known or available mechanism. In a preferred embodiment, a sphere or a ball bearing, preferably using a moveable spring and/or a screw bias, is used to contact and exert a side wall force between one or members of the mounting structure and the axle 50.

It should also be noted that because the weight of the user of the heeling apparatus 10 will exert a significant downward force and the ground or surface will exert an equal force upward, the axle 50, and, hence, the wheel 42 will generally be forced into place. Only when the heel is raised from a surface will any force or friction be required to keep the axle 50 in place. Thus, the present invention does not require a large side force to keep the axle 50 and the wheel 42 in place. The recognition of this fact may be considered an aspect of the present invention for the embodiment as showm. This recognition allows the removable coupling between each end of the axle 50 and the first member 48 and the second member 54 to be optimally designed.

FIG. 3A also illustrates a grind plate 44 (which also may be referred to as a slide plate 44) that may be used in conjunction with the heeling apparatus 10 of the present invention. The grind plate 44 provides a smooth or relatively smooth surface to allow a user to "grind" or "slide" on various surfaces such as hand rails, curbs, steps, corners, and the like. The grind plate 44 is preferably somewhat thin and made of a plastic or polymer material. In a preferred embodiment, the grind plate 44 is removably attached to the arch portion 20 of the outsole 30 of the sole 14. The grind plate 44 may be attached using any known or available fastener, such as, for example, a fastener 46 shown in various locations around the periphery of the grind plate 44.

FIG. 3B further illustrates an axle 52 in which the wheel 42A and the wheel 42B are coupled to either end in the opening 40A and the opening 40B, respectively. The axle 52 extends through both the wheels 42A and 42B and through a portion of sole 14, not visible in FIG. 3B. This serves to support the axle 52 and illustrates the situation where the sole 14 serves as the mounting structure of the wheel assembly. This reduces the overall number of parts. In an alternative embodiment, a metal or some other suitable material may be used within the heel portion 18 of the sole 14 where the axle 52 is positioned to provide additional support and stability. This is an example where the mounting structure is, in effect, integrated into the sole 14. As can be appreciated by one skilled in the art, the present invention may be implemented in any number of ways.

Figure 4:
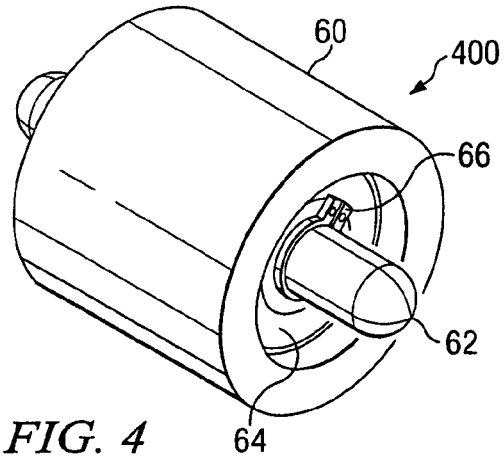
FIG. 4 is a perspective view that illustrates a wheel rotatably mounted to an axle, which also may be referred to as a wheel/axle assembly, for use in a wheel assembly according to one embodiment of the present invention.

FIG. 4 is a perspective view of a wheel 60 rotatably mounted on an axle 62, which also may be referred to as a wheel/axle assembly, for use in a wheel assembly, or in a heeling apparatus, according to one embodiment of the present invention. The wheel 60 and the axle 62 may also be referred to as a wheel/axle assembly 400. In this embodiment, the axle 62 extends through the wheel 60 and includes two ends that are rounded or bullet shaped. A precision bearing 64 is shown positioned in a recess, which is shown as an annular recess, of the wheel 60 to facilitate the rotation of the wheel 60 around the axle 62. Preferably a second precision bearing is positioned in a second recess, not shown in FIG. 4, to further facilitate such rotation.

A slip clip, slip ring, or ring clip 66 is shown positioned around, or nearly around, the axle 62 near the precision bearing 64. This serves to ensure that the precision bearing 64 remains in place in the recess of the wheel 60. The slip clip or ring clip 66 will preferably be positioned on the axle 62 through a groove, such as a radial groove or radial indentation, in the axle 62. It should be understood, however, that one of ordinary skill in the art may use any of a variety of other arrangements to ensure that the precision bearing 64 stays in position. In alternative embodiments, the precision bearing 64 may be eliminated or loose bearings may be used.

The wheel 60 rotatably mounted on the axle 62 may, in alternative embodiments, serve as the wheel assembly of the present invention. In such a case, the axle 62 may be mounted to the sole, such as the midsole and heel portion, at its ends while the wheel 60 is rotatably provided in the opening of the sole. In this manner, the need for a mounting structure may be thought of as eliminated or, alternatively, the mounting structure may be thought of as integrated into the sole of the footwear.

Figure 5:
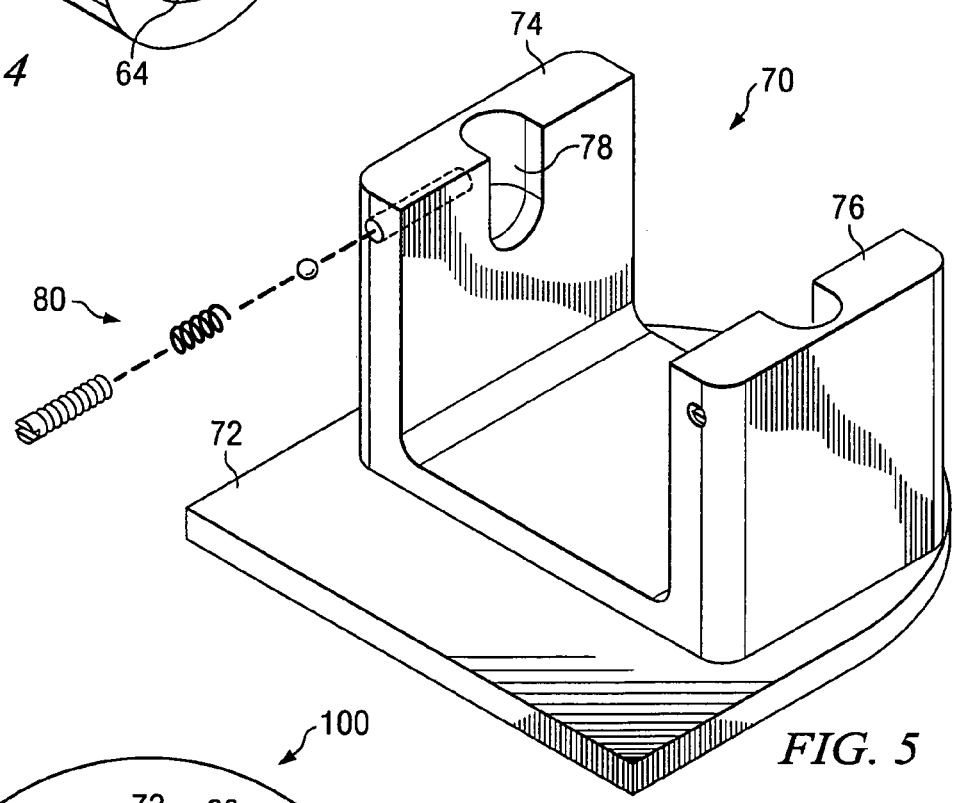
FIG. 5 is a perspective view that illustrates a mounting structure for use with a wheel rotatably mounted to an axle, as illustrated in FIG. 4, to form a wheel assembly.

FIG. 5 is a perspective view of a mounting structure 70 for use with a wheel rotatably mounted to an axle, such as is illustrated in FIG. 4, to form a wheel assembly. The mounting structure 70 generally includes a heel control plate 72, a first member 74, and a second member 76. In alternative embodiments, a spring, such as a leaf spring, could be provided where the two members contact the heel control plate 72. This would provide the added benefit of greater cushion and suspension. The two members include an opening, such as the opening 78 of the first member 74 to receive an end of an axle. It should be mentioned that the opening may be provided in virtually any configuration, including extending through the member, or placed at different positions, or even multiple positions for mounting the wheel/axle assembly 400 at a retractable position and an extended position, on the member.

The axle that is to be positioned in the openings of the first member 74 and the second member 76 will preferably be removably coupled. This may be achieved by any number of arrangements and configurations, all of which fall within the scope of the present invention. One such arrangement is the screw/spring/ball bearing arrangement 80 provided in first member 74. This arrangement provides an adjustable bias or force that can be exerted against the axle when it is inserted into the opening 78. The screw is accessible and adjustable by the user. The turning of the screw affects the compression of a spring which, in turn, provides a force on a ball bearing that extends out into the opening 78. When the axle is inserted into the opening 78, the ball bearing may be displaced an amount and the screw/spring/ball bearing arrangement 80 will provide a side force to allow the axle to be secure, yet removable. A similar arrangement may also be provided in the second member 76 to provide a friction fit or coupling on the other end of the axle 62.

Figure 6:
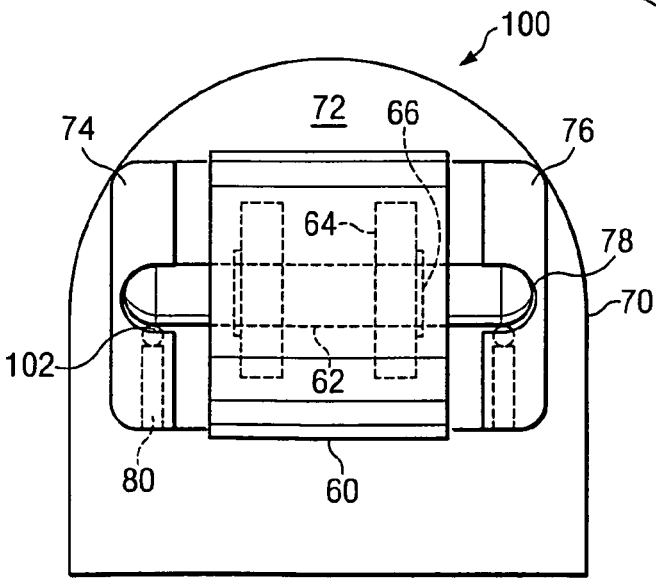
FIG. 6 is a bottom view that illustrates a wheel assembly that includes the wheel rotatably mounted on the axle as shown in FIG. 4 and the mounting structure of FIG. 5.

Although the screw/spring/ball bearing arrangement 80 of FIG. 5 is shown being implemented through a horizontal opening in the first member 74, it may be implemented in using an opening aligned in virtually in manner in the member. For example, the adjustment of the tension or pressure on the screw/spring/ball arrangement 80 may be achieved through a diagonal opening such that the exposed end of the screw/spring/ball arrangement 80, normally a screw head end, is provided where the reference line for numeral 74 in FIG. 5 contacts the first member 74. This provides easier access to adjust the tension and friction fit on the axle 62 when the wheel assembly, such as wheel assembly 100 of FIG. 6, is engaged or positioned within the opening of a sole to form a heeling apparatus. Of course, any of a variety of other arrangements, configurations, and opening alignments may be contemplated and implemented under the present invention.

The mounting structure 70 can be made or constructed of virtually any material, generally depending on the desired mechanical characteristics such as, for example, rigidity and strength. These materials may include, for example, a plastic, a polymer, a metal, an alloy, a wood, a rubber, a composite material, and the like. This may include aluminum, titanium, steel, and a resin. In one embodiment, the mounting structure 70 is made of a metal, such as aluminum, that has been anodized such that the mounting structure 70 presents a black color or hue.

FIG. 6 is a bottom view of a wheel assembly 100 that includes the wheel 60 rotatably mounted to the axle 62, as shown in FIG. 4, and the mounting structure 70 of FIG. 5. The first member 74 and the second member 76 each removably couple with the ends of the axle 62 through a bias mechanism implemented using a bias mechanism, such as the screw/spring/ball bearing arrangement 80. A ball bearing 102 is shown contacting one end of the axle 62 in the opening 78. Further slip clips or ring clips (which may also be referred to as snap rings or slip rings), such as ring clip 66, are provided to ensure that the precision bearings positioned in the recesses of the wheel remain in position.

The heel control plate 72 allows the user of the heeling apparatus to gain greater control and to obtain greater performance out of the heeling apparatus.

Figure 7:
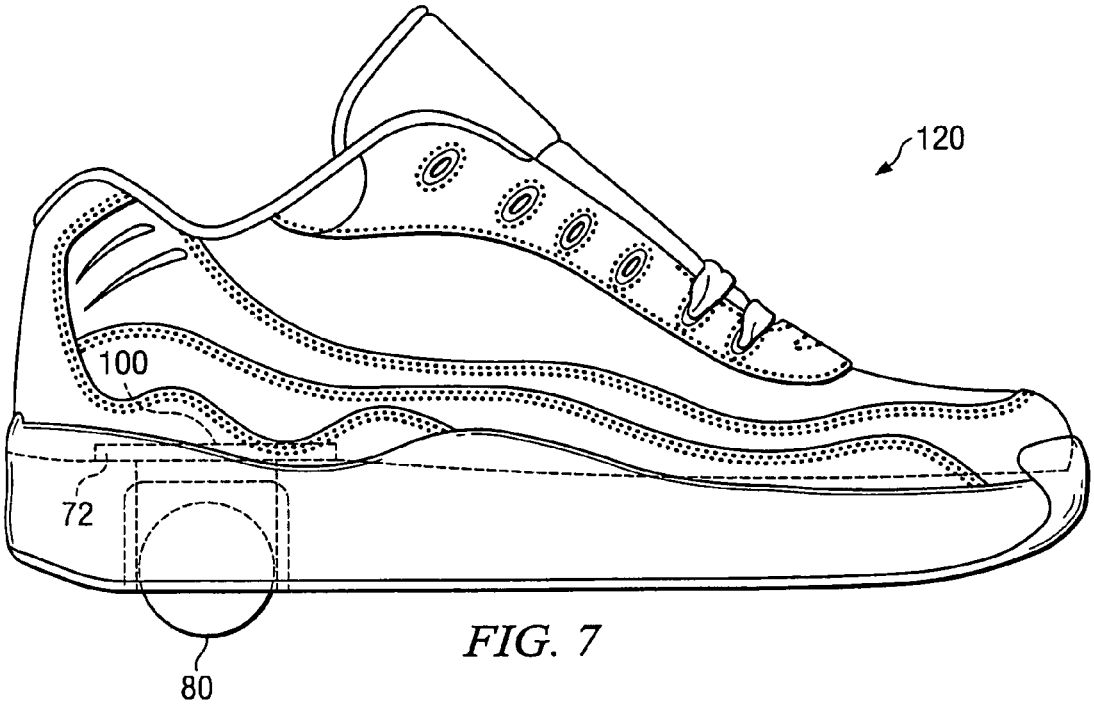
FIG. 7 is a side view that illustrates the wheel assembly positioned above and through the opening in a footwear to form a heeling apparatus.

FIG. 7 is a side view of the wheel assembly 100 positioned above and through the opening to form a heeling apparatus 120. The heel control plate 72 resides inside the shoe so that the heel of the user may apply pressure to the heel control plate as desired to provide better handling and performance of the heeling apparatus 120.

Figure 8A:
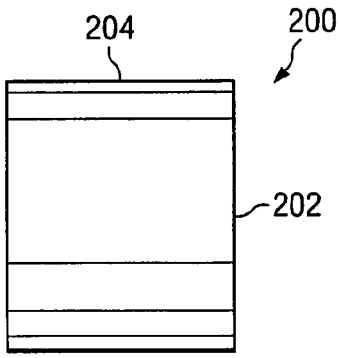
FIGS. 8A, 8B, 8C, and 8D are profile views of various wheels that illustrate the surface profile of these wheels that may used in various embodiments of the present invention.
Figure 8B:
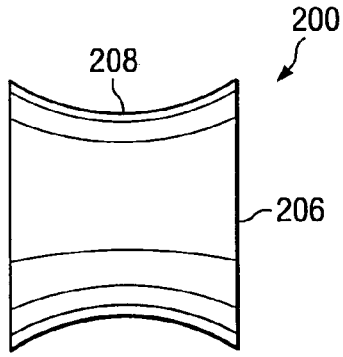
Figure 8C:
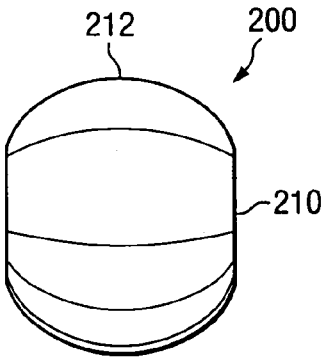
Figure 8D:
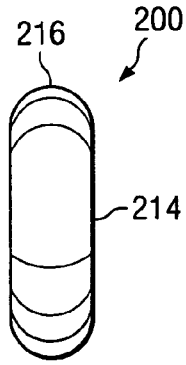

FIGS. 8A, 8B, 8C, and 8D are profile views of various wheels 200 that illustrates the surface profile of these wheels that may used in various embodiments of the present invention. In FIG. 8A, a wheel 202 is shown with a flat or square surface or exterior profile 204. In FIG. 8B, a wheel 206 is shown with an inverted surface profile 208. In FIG. 8*c*, a wheel 210 is shown with round surface profile 212. Finally, in FIG. 8D, a wheel 214 is shown with a steep surface profile 216. The present invention may incorporate virtually any available surface profile of a wheel.

Figure 9:
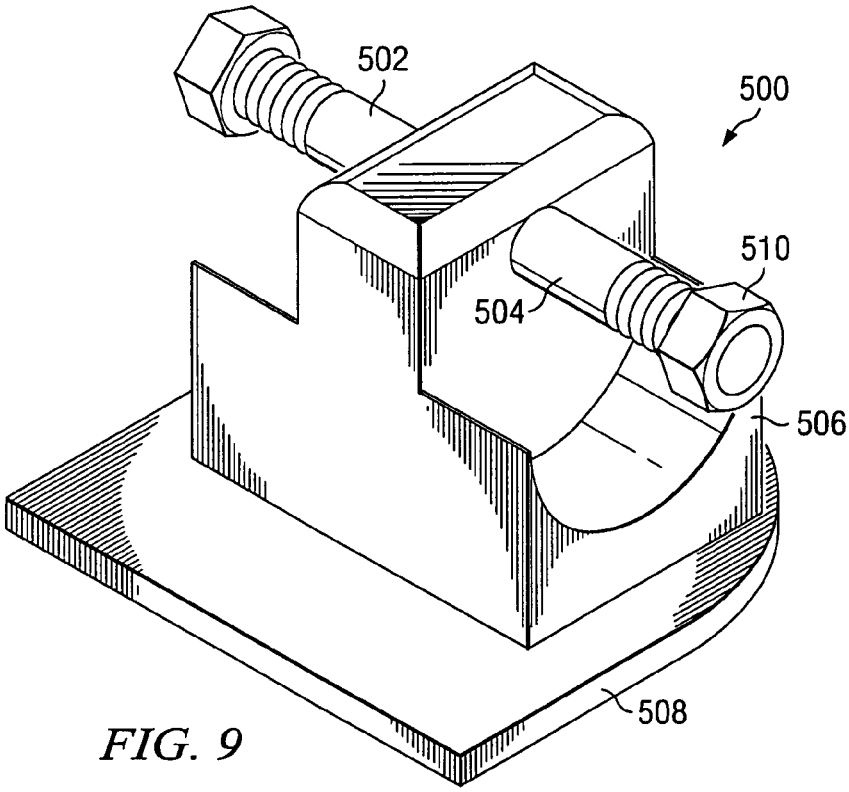
FIG. 9 is a perspective view that illustrates a mounting structure of another embodiment for use in a wheel assembly of a heeling apparatus.

FIG. 9 is a perspective view that illustrates a mounting structure 500 of another embodiment for use in a wheel assembly of a heeling apparatus. The mounting structure 500 includes an axle 502, which may be considered one axle that extends through and is mounted through a member 50 or as an axle 502 that couples with the member 506 along with an axle 504 that couples with the member 506 opposite axle 502. The mounting structure 500 also includes a heel control plate 508 coupled with the member 506.

The mounting structure 500 allows for two wheels to be mounted to form a wheel assembly. A wheel may be rotatably mounted on the axle 502, preferably using a precision bearing, and a wheel may be rotatably mounted on the axle 504, also preferably through a precision bearing as illustrated previously herein.

Figure 10:
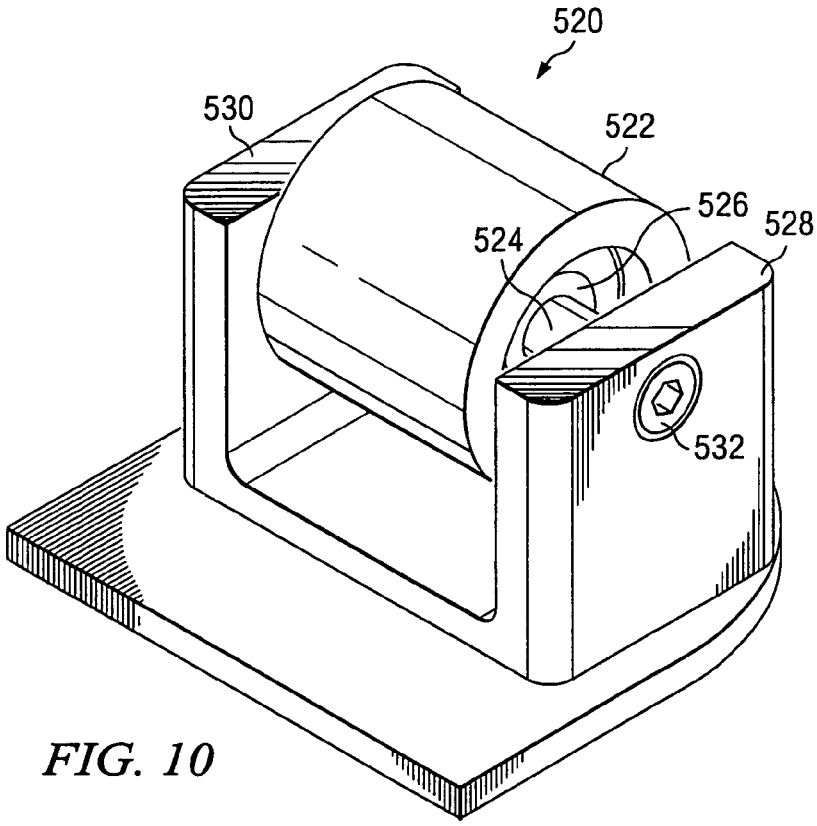
FIG. 10 is a perspective view that illustrates a wheel assembly that uses yet another embodiment for use in a heeling apparatus.

The axle 502 and the axle 504 include a threaded portion such that a nut, such as a lock nut 510 may be included to secure a wheel to each axle. In other embodiments, the end of the axles may include internal threads, as opposed to external threads as shown, so that a screw, such as the hex screw as shown in FIG. 10. It should be understood that virtually any available coupling may be provided between the axle and the member.

FIG. 10 is a perspective view that illustrates a wheel assembly 520 that uses yet another embodiment for use in a heeling apparatus and includes a wheel 522 rotatably mounted to an axle 524 using a precision bearing 526, and a first member 528 and a second member 530 coupled to each end of the axle 524 through a screw, such as hex screw 532. The wheel assembly 520 is similar to wheel assembly 100, which was described above in connection with FIG. 6, except that the wheel/axle assembly cannot be as easily inserted and removed.

Figure 11:
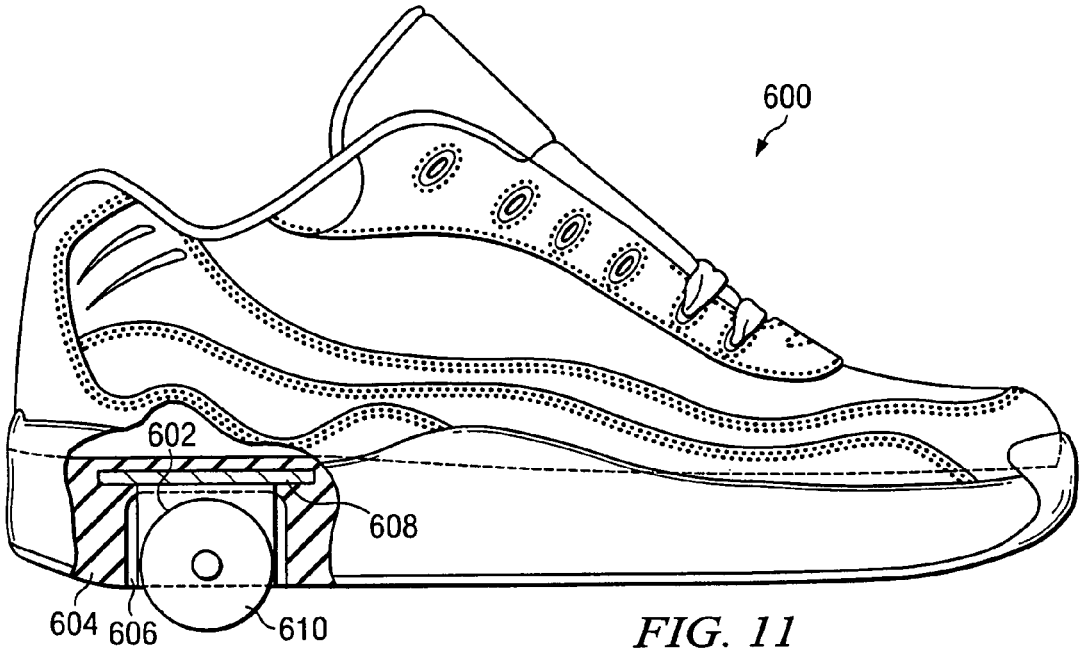
FIG. 11 is a side, partial cutaway view that illustrates one embodiment of a heeling apparatus that illustrates the wheel assembly provided in the sole of the heeling apparatus and the opening in the sole not extending completely through the sole.

FIG. 11 is a side, partial cutaway view that illustrates one embodiment of a heeling apparatus 600 that illustrates a wheel assembly 602 provided in a sole 604 and an opening 606 in the sole 602 that does not extend completely through the sole 602. As such, the mounting structure 608 may be provided or integrated into the sole 602 and may not be readily or easily removed. A wheel 610 is also shown extending partially below the bottom of the sole 602, which provides the advantage of stealth heeling.

FIG. 12 is a side view of another embodiment that illustrates a heeling apparatus 620 of the present invention with a removable wheel cover 622 positioned to cover a wheel 624 and an opening 626 in a sole 628. The removable wheel cover 622 allows for the wheel to be provided in an extended position, i.e., below the bottom surface of the sole 628, yet not engage a surface to roll. Although the heeling apparatus 620 of the present invention allows a user to walk and run, even with the wheel in an engaged position, the removable wheel cover 622 provides protection from dirt and debris and provides greater stability.

In an alternative embodiment, a wheel stop, not expressly shown in FIG. 12, may be provided, in lieu of or in conjunction with the removable wheel cover 622, to stop the rotation of the wheel 624. In one embodiment, the wheel stop is made of virtually any material, such as a sponge or flexible material, that can be wedged between the wheel 624 and the opening 626 to stop or prevent the rotation of the wheel 624 and to stay in place through friction.

In other embodiments of the wheel cover 622, a wheel cover is provided when the wheel 624 has been removed from the heeling apparatus 620. In a preferred embodiment, this wheel cover is generally flush with the remainder of the bottom of the sole 608, and, hence, provides the function of a regular shoe when desired and protects the opening. This wheel cover may couple in any available manner, but preferably will couple to the wheel assembly in the same or similar manner that the wheel/axle assembly couples to the mounting structure. The removable wheel cover could clip or attach to the wheel assembly in many different ways.

FIG. 13 is a bottom view that illustrates another embodiment of a heeling apparatus 700 with a spherical ball 702 serving as a wheel and positioned in a mounting structure 704 in an opening in the heel portion of the sole 706.

Figure 14:
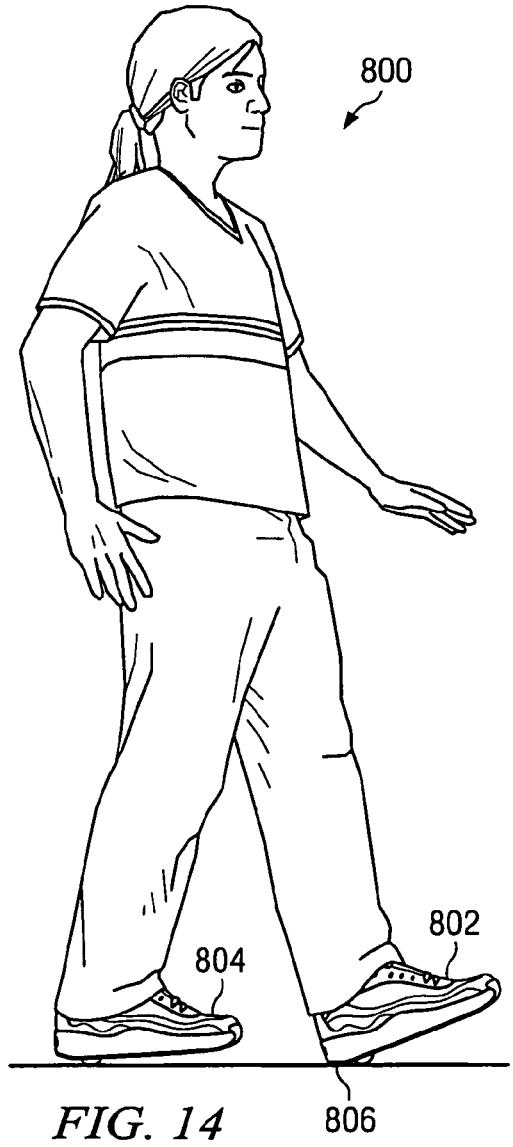
FIG. 14 is a perspective view that illustrates a "heeler" using the present invention to "heel"

FIG. 14 is a perspective view that illustrates a "heeler" 800 using the present invention to "heel." Heeling can be achieved using various techniques and, generally, requires a skill set of balance, positioning, flexibility, and coordination.

An illustrative method for using a heeling apparatus on a surface may include running on a surface by using a forefoot portion of a sole of the heeling apparatus to contact the surface, and then rolling on the surface with a wheel of the heeling apparatus extended below the bottom of the sole through an opening in the sole by using a wheel of the heeling apparatus to contact the surface. Before running on a surface, the method may include walking on the surface while wearing the heeling apparatus with a wheel of the heeling apparatus extended below the bottom of a sole portion of the heeling apparatus before running on the surface. Heeling may also be performed on a hill or a surface that includes a decline.

The method of heeling may also include engaging the wheel of the heeling apparatus to extend below the bottom of the sole portion of the heeling apparatus before walking on the surface. The method may also include walking on the surface while wearing the heeling apparatus before engaging the wheel of the heeling apparatus and with the wheel of the heeling apparatus retracted. Other variations on the method may include transitioning from rolling on the surface to either running, walking, or stopping on the surface by running on the surface through using the forefoot portion of the sole of the heeling apparatus to contact the surface just after rolling on the surface.

The preferred position while heeling is illustrated by the heeler 800 in FIG. 14 where one heeling apparatus 802 is placed in front of the other heeling apparatus 804 while rolling on a surface. As can be seen from a back heel portion 806 of the heeling apparatus 804, sometimes the clearance between the back heel portion 806 and the surface is small. As a result, in a preferred embodiment, the back heel portion 806 is made of a wear resistant material.

The method of heeling may also implement any number of techniques for slowing or stopping. For example, rolling may be slowed by contacting the forefoot portion of the sole of the heeling apparatus to contact the surface to create friction and to remove the wheel from the surface. Another example includes slowing by contacting a heel portion of the sole of the heeling apparatus to contact the surface.

Figure 15:
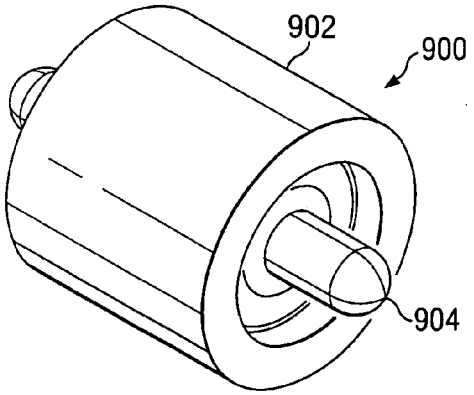
FIG. 15 is a perspective view that illustrates a wheel rotatably mounted to an axle, which also may be referred to as a wheel/axle assembly, similar to FIG. 4.
Figure 16:
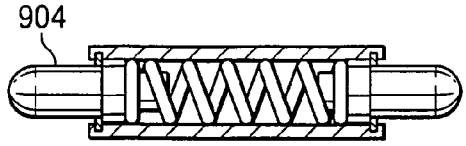
FIG. 16 is a cutaway view that illustrates a collapsible axle of the wheel/axle assembly of FIG. 15 implemented as a spring-loaded collapsible axle.

FIG. 15 is a perspective view that illustrates a wheel 902 rotatably mounted to a collapsible axle 904, which also may be referred to as a wheel/axle assembly 900, similar to FIG. 4. The collapsible axle 904 may be implemented in any number of ways, such as an adjustable axle that is spring loaded, similar to what is shown in FIG. 16, or as a screw collapsible axle. This allows the wheel/axle assembly 900 to be more easily removable and/or retractable to a position where the wheel would not engage the ground if the wheel/axle assembly 900 where implemented in a heeling apparatus.

FIG. 16 is a cutaway view that illustrates a collapsible axle 904 of the wheel/axle assembly 900 of FIG. 15 implemented as a spring loaded collapsible axle. As can be seen, the collapsible axle 904 may be adjusted or shortened by inwardly compressing both ends of the collapsible axle 904 to overcome the internal spring force.

Figure 17:
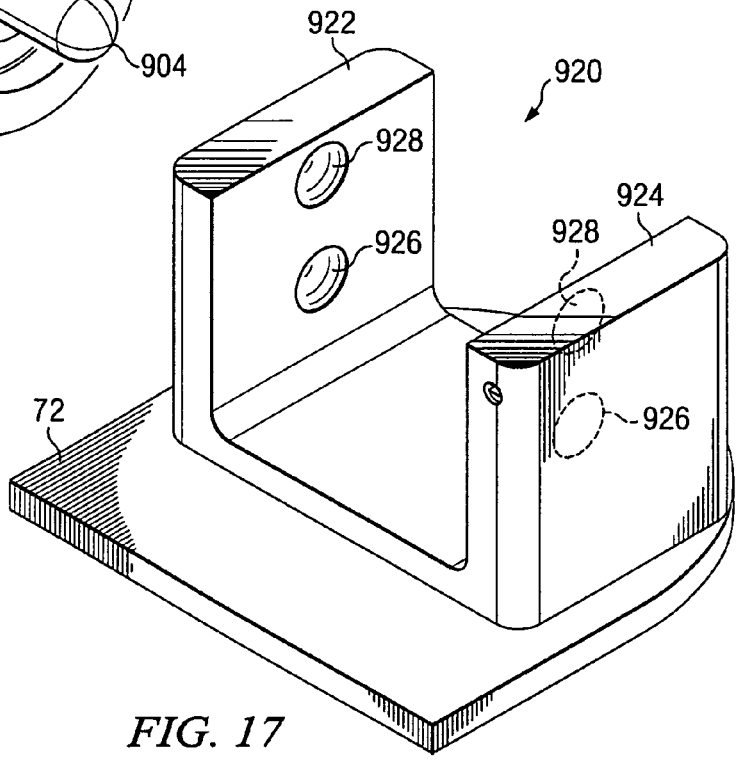
FIG. 17 is a perspective view that illustrates another mounting structure for use with the wheel/axle assembly and the collapsible axle, as illustrated in FIG. 15 and FIG. 16, to form a wheel assembly.

FIG. 17 is a perspective view that illustrates another mounting structure 920 for use with the wheel/axle assembly 900 and the collapsible axle 904, as illustrated in FIG. 15 and FIG. 16, respectively, to form a wheel assembly. The collapsible axle 904 may couple to a first member 922 and a second member 924 at a first position 926 at the first member 922 and the second member 924 so that the wheel is in a retracted position. The collapsible axle 904 may also couple to the first member 922 and the second member 924 at a second position 928 so that the wheel is in an extended position.

Figure 18:
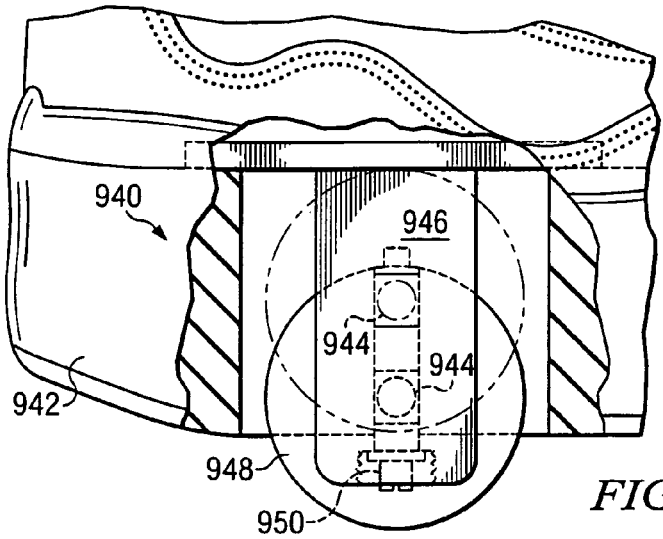
FIG. 18 is a side, cutaway view that illustrates a wheel assembly positioned through an opening in a sole that illustrates one embodiment of an axle that couples to the mounting structure to provide a retractable wheel using an assembly that may be referred to as a king pin arrangement.

FIG. 18 is a side, cutaway view that illustrates a wheel assembly 940 positioned through an opening in a sole 942 that illustrates one embodiment of an axle 944 that couples to a mounting structure 946 to provide a retractable wheel 948 using an assembly that may be referred to as a king pin arrangement or dual king pin arrangement. This allows the retractable wheel 948 to be adjusted up or down, as desired, and from a retractable position to an extended position. A king pin 950 (which may be implemented as a threaded screw or bolt) is shown threadingly engaged in a threaded opening in a member of the mounting structure 946. As the king pin 950 is screwed further into the opening in the member, the axle 944 is further retracted. A king pin 950 will also be provided at the other member to raise the other side of the axle 944. In other embodiments, such as the mounting structure 500 in FIG. 9, a single king pin could be provided through the single member to provide retractable wheels through the coupling of the members and the axle.

An example of a king pin type assembly is illustrated in U.S. Pat. No. 4,295,655, which is incorporated herein by reference for all purposes, issued to David L. Landay, et al., was filed on Jul. 18, 1979, was issued Oct. 20, 1981. This patent illustrates a king pin type assembly that could be implemented in an embodiment of the present invention.

FIG. 19 is a bottom view that illustrates the wheel assembly 940 of FIG. 18 and further illustrates the dual king pin arrangement and the king pins 950 through the members of the mounting structure 946.

FIG. 20 is a side view that illustrates one member of the mounting structure 946 and further illustrates the coupling of the axle 944 to the mounting structure 946 using the dual king pin arrangement similar to FIG. 18. As discussed above, this allows the axle 944, and hence the attached wheel, to be transitioned to any of a desired levels, and from a retracted position to an extended position.

It should be understood that the axle may couple to a member of a mounting structure using any available technique and in virtually an unlimited number of ways. For example, an axle may couple to the first member and the second member of a mounting structure to move from a retracted position to an extended position through a spring arrangement. Similarly, an axle may couple to the first member and the second member of a mounting structure to move from a retracted position to an extended position through a hinged arrangement.

Many other examples are possible, for example U.S. Pat. No. 3,983,643, which is incorporated herein by reference for all purposes, issued to Walter Schreyer, et al., was filed on May 23, 1975, was issued Oct. 5, 1976 illustrates a retractable mechanism that may implemented in one embodiment of the present invention. U.S. Pat. No. 5,785,327, which is incorporated herein by reference for all purposes, issued to Raymond J. Gallant, was filed on Jun. 20, 1997, issued on Jul. 28, 1998 illustrates simultaneously retractable wheels.

FIG. 21 is a breakaway and perspective view that illustrates a two piece wheel 970 that includes an inner core 972, an outer tire 974, such as a urethane wheel, an axle 976 (which may not be shown to skill), and a bearing 978 that may be used in the present invention. In a preferred embodiment, the bearing 978 is small in comparison to the two piece wheel 970, for example, the bearing 978 may have an outer diameter that is less than half the outer diameter of the outer tire 974. This can provide significant advantages, that include a softer ride, better control, and are longer lasting. This is because the outer tire 974 can be larger and thicker. In other embodiments, the bearing 978 is larger and has an outer diameter that is more than half the outer diameter of the outer tire 974. In a preferred embodiment, the inner core portion of the two piece wheel is made of a harder material that provides rigidity for enhanced bearing support, while the outer tire portion is made of a softer material, such as a soft urethane, for improved performance and a quieter ride. These types of wheels may be referred to as a "dual durometer" type wheel.

Figure 22:
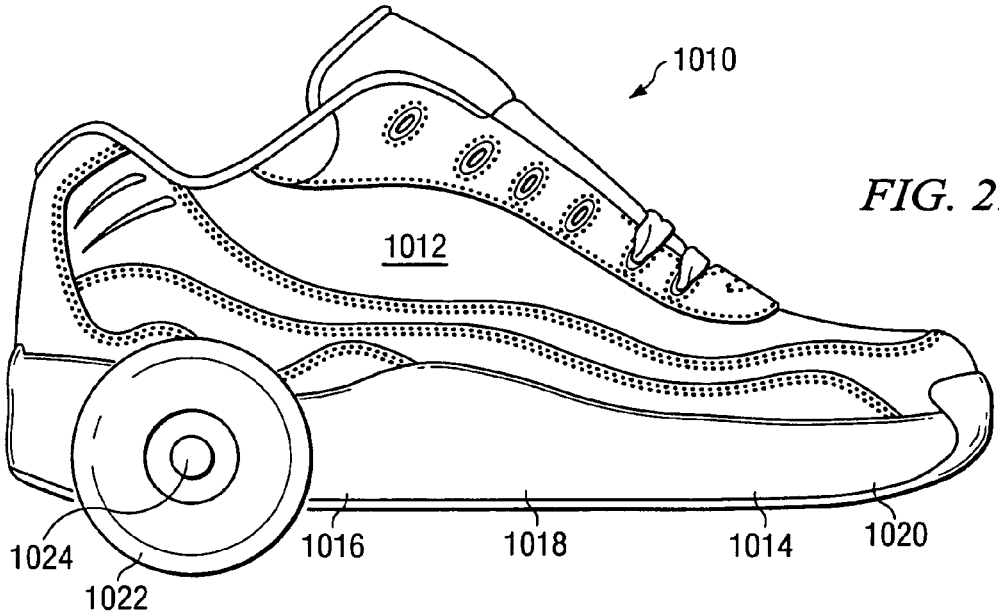
FIG. 22 is a side view of an external wheeled heeling apparatus constructed in accordance with one aspect of the present invention.

FIG. 22 illustrates an external wheeled heeling apparatus 1010 constructed in accordance with the present invention for use by a user for heeling. The inventor of the present application revolutionized the active footwear industry by providing a heeling apparatus as a substitute for skating enabling a user to walk on a portion of a footwear and roll on a second portion of the footwear. The inventor came to realize that aggressive heelers desired greater performance which necessitated an improved design to accommodate these heelers. The present invention is provided to satisfy the need for a high performance heeling apparatus.

The external wheeled heeling assembly 1010 includes a footwear 1012 having a sole 1014. The sole 1014 of the footwear 1012 includes a heel portion 1016, an arch portion 1018, and a forefoot portion 1020. It should be appreciated that there is no clear line of demarcation between the heel portion 1016 and the arch portion 1018 or between the arch portion 1018 and the forefoot portion 1020, and for this reason, these portions of the sole 1014 are referred to only generally with respect to the areas of the sole 1014.

Figure 23:
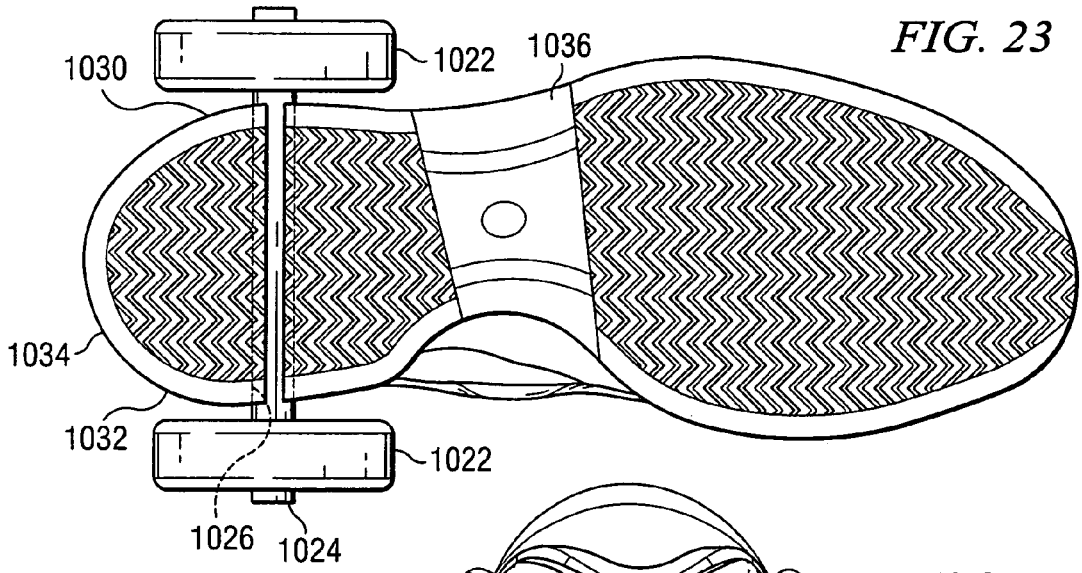
FIG. 23 is a bottom view of the invention illustrated in FIG. 22 showing an axle extending through a sole portion of the footwear.

Referring also to FIG. 23, the external wheeled heeling apparatus is provided with wheels 1022 rotatably connected to an axle 1024 extending through a portion of the heel portion 1016 of the sole 1014. In this aspect, the sole 1014 is provided with an opening 1026 within the sole 1014 extending from a first side 1030 to a second side 1032 of the heel portion 1016 of the sole 1014. The opening 1026 is sized to receive the axle 1024 through the opening 1026.

In one aspect, the axle may be provided directly through the opening 1026 in the sole 1014. In other aspects, however, a sleeve (not shown), which may be a tubular member cylindrically shaped constructed from a rigid plastic or other materials, may be provided within the opening 1026 to line the opening 1026 and provide a more rigid housing for retaining the axle 1024. In this illustration, it can be seen that the wheels 1022 are disposed adjacent an outer peripheral edge 1034 of the heel portion 1016 of the sole 1014. The wheels in some aspects may be closer to the outer peripheral edge 1034 of the heel portion 1016 while in other aspects the axle 1026 may be elongated such that the wheels 1022 are disposed at a greater distance from the outer peripheral edge 1034.

According to one aspect of the present invention, a grind plate 1036 may be positioned on the bottom of the footwear 1012 near the arch portion 1018 of the sole 1014 useful for grinding. The grind plate 1036 may be attached using a number of attachment methods which are well known and may be constructed from a variety of materials, such as rigid polymeric materials. The grind plate 1036 disposed in the arch portion 1018 provides additional functionality for the external wheeled heeling apparatus 1010 in that users may not only use the present invention for heeling, but also for grinding on sidewalks, hand-rails, and other locations.

Figure 24:
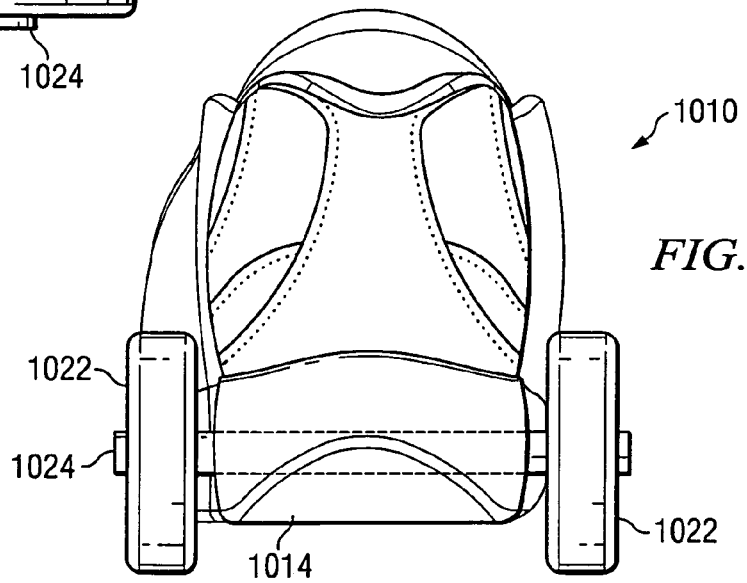
FIG. 24 is a back view of the invention illustrated in FIGS. 22 and 23 showing the wheels positioned adjacent the sole portion of the footwear.

FIG. 24 illustrates a back view of the external wheeled heeling apparatus 1010. In this aspect, it can be seen that the disposition of the wheels 1622 beside the heel portion 1016 of the sole 1014 provides increased stability for a user while heeling. The additional stability provided by this configuration is derived from the wider wheel-base and greater versatility with respect to the configuration of the wheels 1022 and anchoring of the axle 1024 within the sole 1014. As such, this configuration provides more control, stability, ease and versatility of turning and a myriad of other advantages when utilizing the external wheeled heeling apparatus 1010 for high performance heeling.

Figure 25:
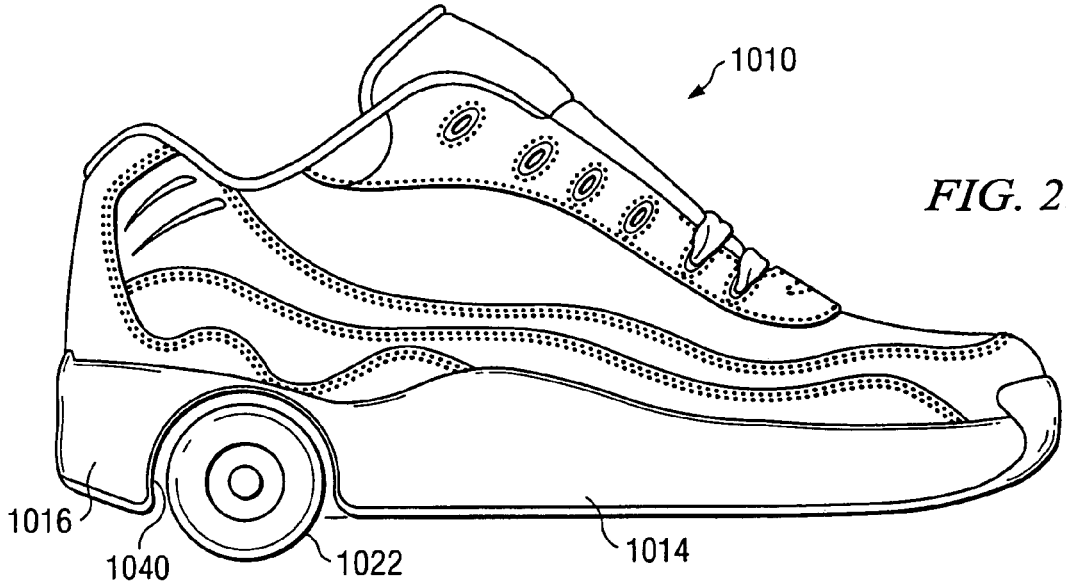
FIG. 25 illustrates the present invention constructed in accordance with another aspect showing the sole provided with a recess wherein the wheel is disposed.
Figure 26:
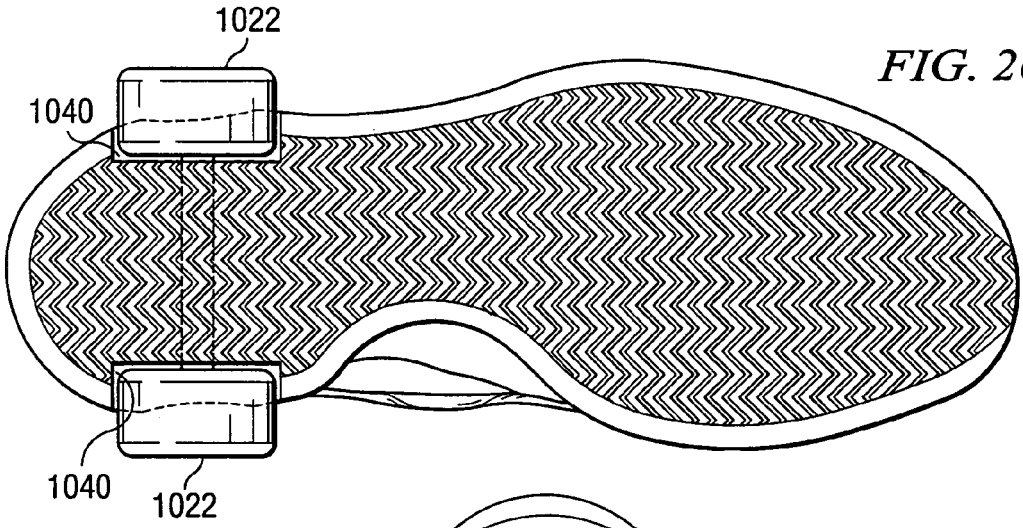
FIG. 26 is a bottom view of the footwear illustrated in FIG. 25.

FIG. 25 illustrates another aspect of the multi-wheeled heeling apparatus 1010 having wheels 1022 disposed in an opening 1040 in the heel portion 1016 of the sole 1014. Referring also to FIG. 26, an underside of the external wheeled heeling apparatus 1010 illustrated in FIG. 25 showing the wheels 1022 disposed partially within the opening 1040 in the sole 1014. In this aspect, it can be seen that a slightly smaller wheel may be used such that it is disposed within the wheel-well like opening 1040 in the sole 1014. The present aspect provides a low profile while maintaining the additional advantages attained by the present invention of increased stability, controllability and other previously discussed advantages.

Figure 27:
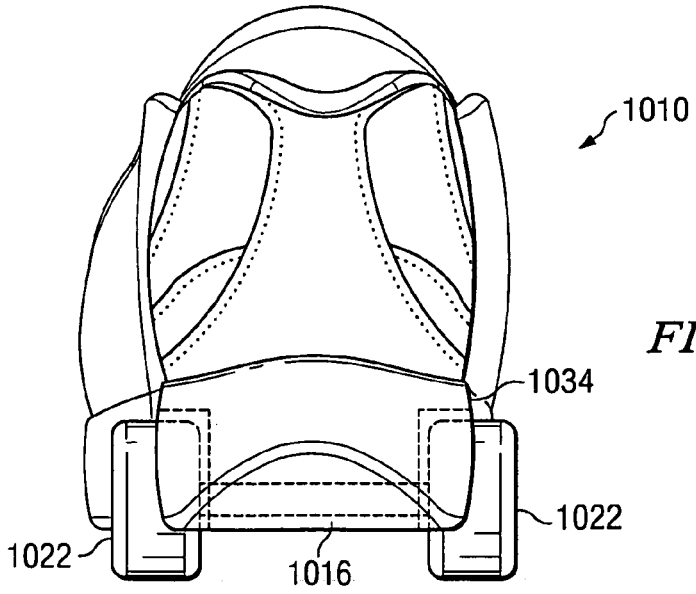
FIG. 27 is a back view of the footwear illustrated in FIGS. 25 and 26 showing the wheels disposed partially under a heel portion of the sole of the footwear and partially extending laterally from the sole of the footwear.

FIG. 27 illustrates a back view of the present aspect of the external wheeled heeling apparatus 1010 showing the disposition of the wheels 1022 wherein at least a portion of the wheels 1022 extend beyond the outer peripheral edge 1034 of the heel portion 1016 of the sole 1014.

Figure 28:
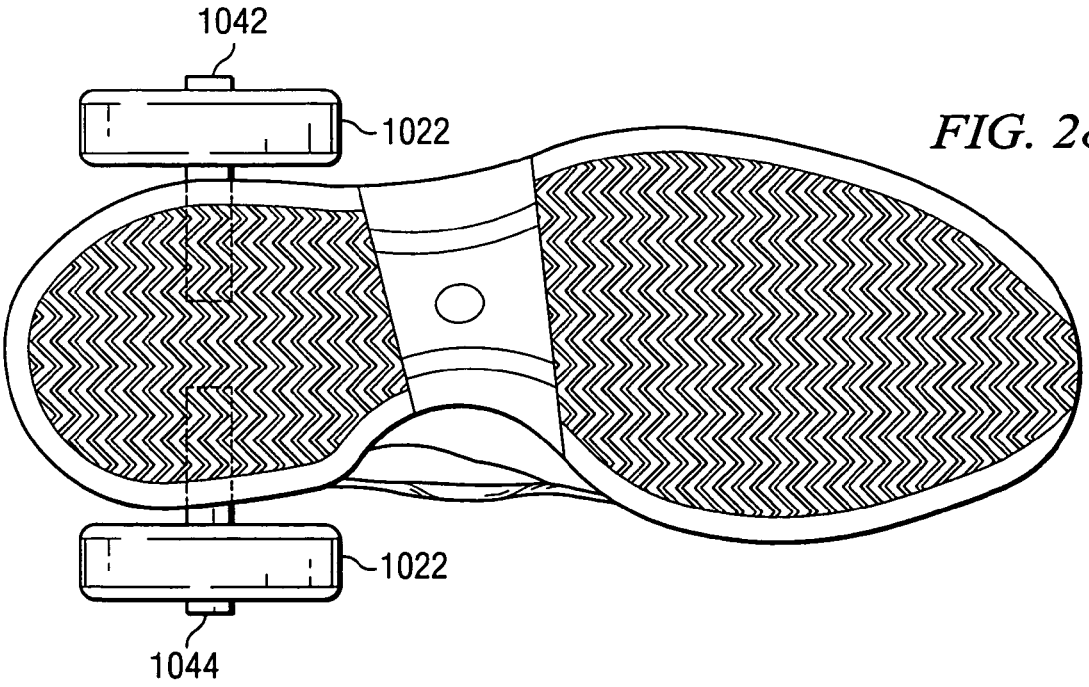
FIG. 28 is a bottom view of another aspect of the present invention illustrating a first and a second axle coupled to a first and second wheel.

FIG. 28 illustrates another aspect of the present invention of the external wheeled heeling apparatus 1010 utilizing a first and second axle 1042 and 1044 connected to the wheels 1022. The first axle 1042 and second axle 1044 may be attached to the sole 1014 in a variety of manners including utilizing bonding material or other couplings, such as a threaded connection of the axles to the sole 1014 or other means of attachment which are well known and will readily suggest themselves to one of ordinary skill in the art.

One advantage to providing independent axles is that the axles are able to move, from a suspension standpoint, independently of one another which may be useful when performing certain more complex movements. The polymeric configuration of the sole 1014 acts as a shock absorber to cushion the attached axles 1042 and 1044, similar to the axle 1024 above, as well as to promote engagement of the wheels 1022 to the surface upon which the user is rolling. Additional suspension configurations will be discussed in greater detail hereinafter.

Figure 29:
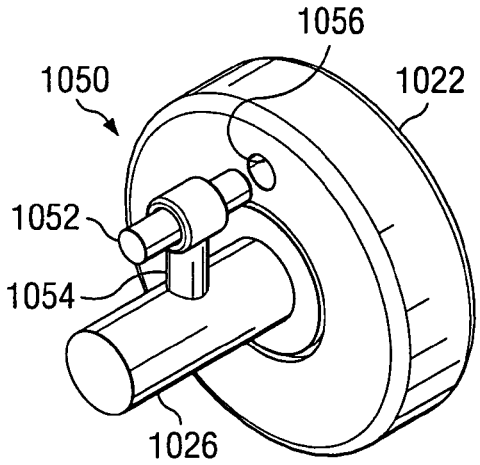
FIG. 29 is a perspective view of a locking mechanism constructed in accordance with one aspect of the present invention for locking the wheel to prevent rotation.

According to another aspect of the present invention, FIG. 29 illustrates a locking mechanism 1050 operable for locking the wheel 1022 to prevent rotation of the wheel 1022. In this view, the locking mechanism 1050 is provided with a shaft 1052 slidingly attached to a coupling 1054 and operable for sliding such that the shaft 1052 may be disposed in an opening 1056 in the wheel 1022. It can be seen that when the shaft 1052 is disposed within the opening 1056 of the wheel 1022, the wheel 1022 is prevented from rotating since the shaft 1052 is connected to the axle 1026 via the coupling 1054.

Figure 30:
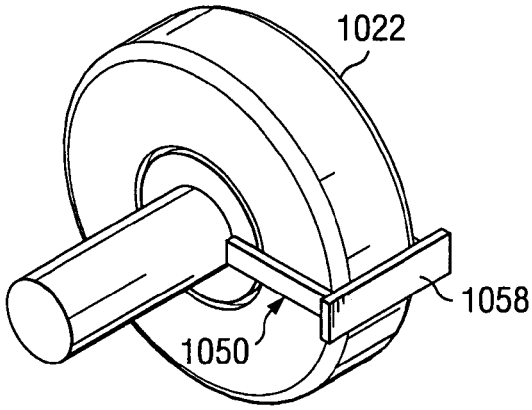
FIG. 30 is a perspective view of another aspect of the locking mechanism.

FIG. 30 illustrates another aspect of the locking mechanism 1050 operable for inhibiting the rotation of the wheel 1022. In this aspect, the locking mechanism 1050 is shown as a brake having a pad 1058 which may be caused to engage a surface of the wheel 1022 to frictionally engage the wheel 1022 to prevent rotation. It will be appreciated to one of ordinary skill in the art that a wide range of locking mechanisms may be constructed and are useful for the purposes of preventing the wheel 1022 from rotating and for the purposes of brevity for this disclosure the large number of possible locking mechanisms 1050 will not be discussed in greater detail.

One advantage of the present invention is the locking mechanism 1050 is operable to allow the user to lock the wheel 1022 and prevent rotation allowing the user to walk while wearing the external wheeled heeling apparatus 1010 without rolling to provide increased stability when walking or running as if wearing an ordinary shoe. According to another aspect of the present invention, the wheels 1022 may be removed from the axle 1024, also for the purposes of allowing the user to utilize the external wheeled heeling apparatus 1010 as an ordinary tennis shoe when the user does not desire to heel or roll.

The axle may be configured with the standard threaded end to receive a nut for securing the wheels 1022 and to promote easy removal of the wheels 1022 when appropriate. The configuration to promote easy wheel removal, similar to the locking mechanism 1050, may be achieved in a large number of well-known configurations which will not be discussed herein for the purposes of brevity.

Figure 31:
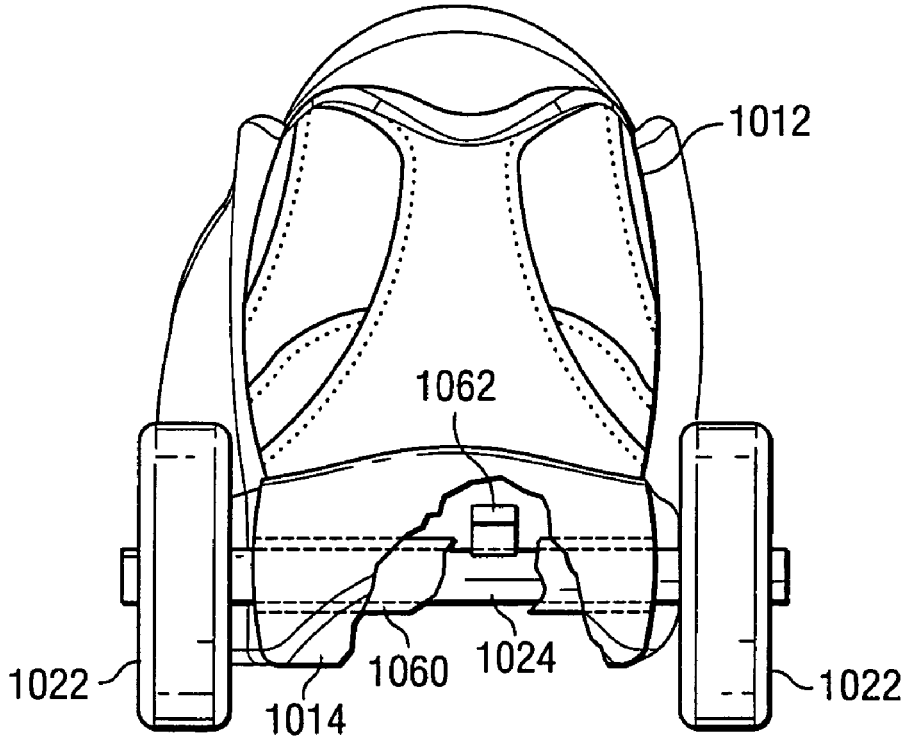
FIG. 31 is a back view of the footwear illustrating another aspect of the present invention.

FIG. 31 illustrates another aspect of the present invention of the external wheeled heeling apparatus 1010 showing a partial cutaway exposing a sleeve 1060 disposed through the opening 1026 in the sole 1014. The axle 1024 is positioned within the sleeve and extending through the sole 1014 for connection to the wheels 1022. In this aspect, a cantilever mechanism 1062 is provided in the sole 1014 and engaging the axle 1024.

Figure 32:
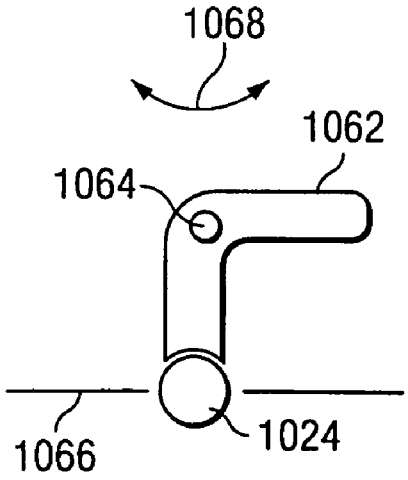
FIG. 32 is a side view of a suspension system and a cantilever mechanism operable to elevate the axle and wheels to enable a user to walk while wearing the footwear.
Figure 33:
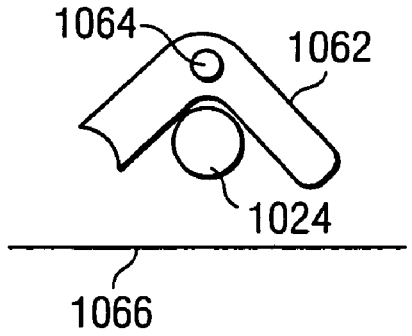
FIG. 33 illustrates the cantilever mechanism in a position to raise the axle.

Referring also to FIGS. 32 and 33, the cantilever mechanism 1062 may be provided to a hinging coupling 1064 within the sole 1014 disposed above the axle 1024. The axle 1024, in this aspect, may be provided with a biasing mechanism (not shown) forcing the axle in an upward direction when disposed within the sleeve 1060 generally toward the upper part of the footwear 1012 such that the wheels 1022 may be caused to raise to a point where the wheels 1022 may not engage the surface. This may be useful, as previously discussed, to allow the user to walk as with ordinary tennis shoes when the user does not wish to roll or heel.

The cantilever 1062 forces the axle in a downward direction toward the bottom of the sole 1014 causing the wheels 1022 connected to the axle 1024 to be disposed low enough relative to the sole 1014 for the wheels 1022 to engage the surface. The cantilever mechanism 1062, when rotated, as illustrated in FIG. 33, may disengage the axle 1024 and allow the axle 1024 to raise relative to a plane 1066. Thus, it can be seen that when the cantilever mechanism 1062 is in an engaged position, as illustrated in FIG. 32, the axle 1024 is lowered relative to the plane 1066 as opposed to a disengaged position, as in FIG. 33, where the axle 1024 moves higher than the plane 1066. The basis for the movement of the axle 1024 may be, as previously discussed, a biasing mechanism such as a spring or other device causing upward tension on the axle 1024. It will be appreciated that although the bias mechanism is shown moving relative to the hinged coupling 1064, it may also move in an arching direction 1068 moving the cantilever mechanism 1062 side-to-side which would operate as well. A variety of cantilever mechanisms 1062 or other configurations useful for raising and lowering the axle 1024 will readily suggest themselves to one of ordinary skill in the art and will not be discussed in greater detail for the purposes of brevity.

Figure 34:
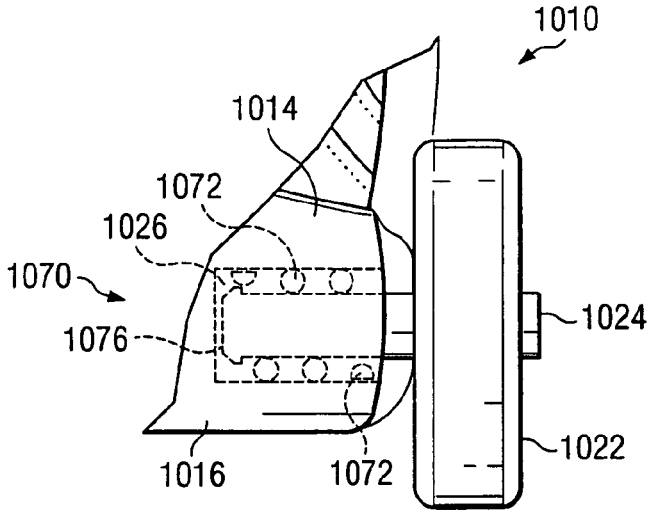
FIG. 34 illustrates a suspension mechanism provided in the sole of the footwear according to yet another aspect of the present invention.

FIG. 34 illustrates a partial back view of the external wheeled heeling apparatus 1010 showing a suspension mechanism 1070 in phantom disposed within the heel portion 1016 of the sole 1014. In this aspect, dual axles 1024 are provided although only a first axle 1024 is shown. The axle 1024 is able to move freely within the opening 1026 within the sole 1014. The suspension mechanism 1070, in this aspect, is illustrated as a plurality of springs 1072, although a number of tensioning devices could also be used, disposed within the opening 1026 in the sole 1014. It can be seen that the axle 1024, when fixed at the first end 1076 of the axle 1024 to the sole 1014, may move freely within the opening 1026 under the tension of the springs 1072 which provide the axle 1024 limited motion within the opening 1026 for shock absorption and improved engagement of the wheel 1022 with the surface while rolling or heeling.

The present invention provides numerous advantages including enabling one to heel by raising a forefoot portion 1020 of the footwear 1012 and transitioning to a rolling state wherein the user rolls on the wheels 1022 of the external wheeled heeling apparatus 1010.

According to one aspect, the present invention provides a method similar to that illustrated in FIG. 14 above, however, utilizing the external wheeled heeling apparatus 1010 for transitioning from a stationery state to a rolling state on a surface. The method includes contacting at least a portion of a forefoot portion 1020 of the footwear 1012 on a surface to inhibit rolling. As previously described, the forefoot portion 1020 is inoperable for rolling. The sole 1014 having the heel portion 1016 provided with a first side and a second side and the sole 1014 further having the arch portion 1018. The method provides for elevating the forefoot portion 1020 of the sole 1014 relative to the surface such that either none or an insubstantial portion of the user's weight is supported by the forefoot portion 1020 of the footwear 1012.

The method further provides for rolling on the surface using a first and second wheels, such as the wheels 1022, wherein a first wheel is operable to rotate adjacent the first side of the heel portion 1016 of the sole 1014 and using a second wheel operable to rotate adjacent the second side of the heel portion 1016 of the sole 1014 while supporting at least a portion of the user's weight.

Figure 35:
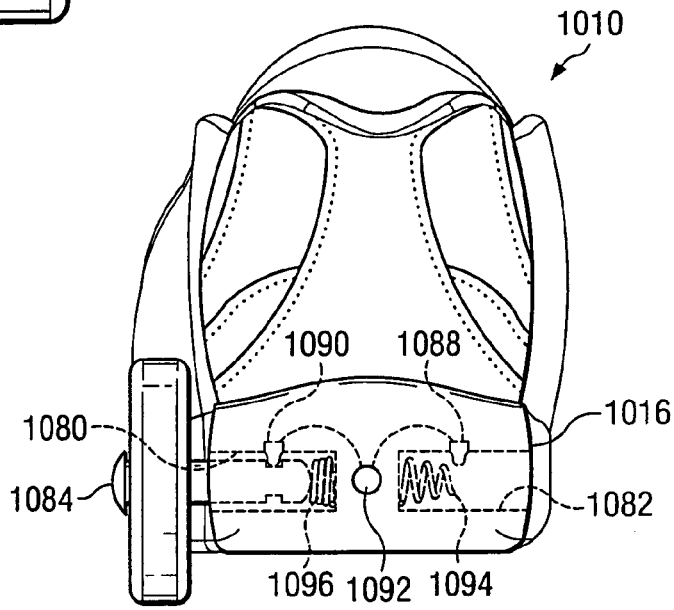
FIG. 35 is a back view of another aspect of the present invention illustrating a retaining mechanism and a release mechanism in phantom.
Figure 36:
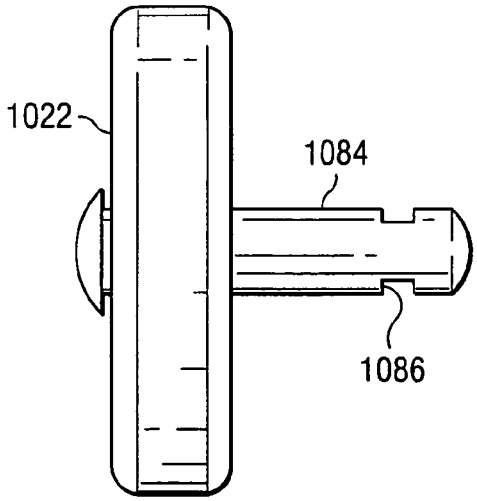
FIG. 36 is a side view of another aspect of the axle of the present invention with a coupling portion to retain the axle.

FIG. 35 illustrates another aspect of the external wheeled heeling apparatus 1010 where the heel portion 1016 of the sole 1014 is provided with a first opening 1080 and a second opening 1082. In some aspects (not shown) a sleeve or tubular member may be disposed within the first and second openings 1080 and 1082 to provide additional support for the wheel and axle assemblies. Referring also to FIG. 36, another aspect of an axle 1084 is illustrated wherein the first end of the axle 1084 is provided with a coupling portion 1086 which may be a notch, recess or other coupling, for example, for retaining the axle 1084 within the first and second openings 1080 and 1082.

In the present aspect, the external wheeled heeling apparatus 1010 is further provided with a first retaining mechanism 1088 in communication with the second opening 1082. The first retaining mechanism 1088 is provided to couple to the coupling portion 1086 of the axle 1084 to retain the axle 1084 within the second opening 1082.

In aspects where a single axle is provided, only a single retaining mechanism, such as the first retaining mechanism 1088 will be necessary for retaining the axle within the heel portion 1016 of the sole 1014. In the present aspect, however, where a first and a second opening 1080 and 1082 are provided for receiving two separate axles 1084 a second retaining mechanism 1090 is used for retaining a second axle 1084 provided in the first opening 1080.

A release mechanism 1092 provided on the external wheeled heeling apparatus 1010 in communication with the first and second retaining mechanisms 1088 and 1090 to operably release the first and second retaining mechanisms 1080 and 1090 from coupling to the axles 1084. This may be accomplished in a number of manners, including a coil spring, clip, hinge or a variety of other releasable couplings which are within the spirit and scope of the present invention as disclosed and described herein.

In some aspects, the present invention may include a first and second springs 1094 and 1096 within the second and first openings 1082 and 1080, respectively, for biasing the axle 1084 to force the axle 1084 from the first and second openings 1080 and 1082, once the retaining mechanisms 1088 and 1090 have been released by the release mechanism 1092. This allows the axles 1084 to be partially ejected from the first and second openings 1080 and 1082 once the release mechanism 1092 is operated. According to some aspects, the wheels 1022 may be independently removable from the axle 1084 such that any mechanical defect, breakdown or cleaning of the axle 1084 or wheel 1022 may be readily accomplished.

For additional understanding of the present invention, incorporated herein by reference are U.S. Pat. No. 5,970,631 to Inman, U.S. Pat. No. 6,006,451 to Morris et al., U.S. Pat. No. 6,115,946 to Morris et al., U.S. Pat. No. 6,151,806 to Morris et al., U.S. Pat. No. 6,158,150 to Morris et al.

Thus, it is apparent that there has been provided, in accordance with the present invention, a external wheeled heeling apparatus that satisfies one or more of the advantages set forth above. Although the preferred embodiment has been described in detail, it should be understood that various changes, substitutions, and alterations can be made herein without departing from the scope of the present invention, even if all of the advantages identified above are not present. For example, the various elements or components may be combined or integrated in another system or certain features may not be implemented.

Also, the components, techniques, systems, sub-systems, layers, compositions and methods described and illustrated in the preferred embodiment as discrete or separate may be combined or integrated with other components, systems, modules, techniques, or methods without departing from the scope of the present invention. Other examples of changes, substitutions, and alterations are readily ascertainable by one skilled in the art and could be made without departing from the spirit and scope of the present invention.

What is claimed is:

1. An external wheeled heeling apparatus for walking and running and transitioning to rolling on a surface, the external wheeled heeling apparatus comprising:

a sole having a forefoot portion, an arch portion, and a heel portion, wherein the forefoot portion is provided with a first side of the forefoot portion and a second side of the forefoot portion, and the heel portion is provided with a first wheel-well opening adjacent a first side of the heel portion and a second wheel-well opening adjacent a second side of the heel portion, the forefoot operable to engage the surface for walking and running, and wherein the forefoot portion of the sole is inoperable for rolling on the surface, and the first side of the forefoot portion of the sole and the second side of the forefoot portion of the sole are not configured to couple with a rolling means to allow a user of the external wheeled heeling apparatus to roll on the surface;

a first wheel operably coupled to rotate adjacent the first wheel-well opening of the heel portion, and the first wheel is positioned at least partially within the first wheel-well; and a second wheel operably coupled to rotate adjacent the second wheel-well opening of the heel portion, and the second wheel is positioned at least partially within the second wheel-well, and wherein the first wheel and the second wheel are positioned such that, in use, in a non-rolling mode a primary contact of the external wheeled heeling apparatus with the surface is provided by the forefoot portion of the sole and as such the external wheeled heeling apparatus does not roll and, in a rolling mode, the first wheel and the second wheel provide a primary contact with the surface to allow the user to roll on the surface, a change in mode being effected by a transfer in weight of the user from the forefoot portion to the first wheel and the second wheel.

2. The external wheeled heeling apparatus of claim 1, wherein the first wheel is positioned entirely within the first wheel-well opening.

3. The external wheeled heeling apparatus of claim 1, further comprising an axle, and wherein the first wheel is rotatably coupled to the axle.

4. The external wheeled heeling apparatus of claim 3, wherein the first wheel is removably coupled to the axle.

5. The external wheeled heeling apparatus of claim 3, wherein the axle is removable.

6. The external wheeled heeling apparatus of claim 1, further comprising a grind plate coupled to the arch portion of the sole.

7. An external wheeled heeling apparatus for walking and running and transitioning to rolling on a surface, the external wheeled heeling apparatus comprising:

a footwear provided with a sole having a forefoot portion, a heel portion and an arch portion, the forefoot portion of the sole having a first side and a second side, and the forefoot portion of the sole inoperable for rolling provides a primary contact with the surface for walking and running and to inhibit rolling, and wherein the heel portion is provided with a first wheel-well opening adjacent a first side of the heel portion and a second wheel-well opening adjacent a second side of the heel portion, and wherein the first side of the forefoot portion of the sole and the second side of the forefoot portion of the sole are not configured to couple with a rolling means to allow a user of the external wheeled heeling apparatus to roll on the surface;

a first axle having a first end and a second end, the first axle coupled to the heel portion of the sole;

a second axle having a first end and a second end, the second axle coupled to the heel portion of the sole;

a first wheel mounted on the first axle at the first end of the first axle such that the first wheel is positioned and operably coupled to rotate adjacent the first wheel-well opening of the heel portion, and the first wheel is positioned at least partially within the first wheel-well; and a second wheel mounted on the second axle at the first end of the second axle such that the second wheel is positioned and operably coupled to rotate adjacent the second wheel-well opening of the heel portion, and the second wheel is positioned at least partially within the second wheel-well.

8. The external wheeled heeling apparatus of claim 7, wherein the first wheel is positioned entirely within the first wheel-well opening.

9. The external wheeled heeling apparatus of claim 7, wherein the first wheel is rotatably coupled to the first axle.

10. The external wheeled heeling apparatus of claim 9, wherein the first wheel is removably coupled to the first axle.

11. The external wheeled heeling apparatus of claim 9, wherein the first axle is removable.

12. The external wheeled heeling apparatus of claim 7, further comprising a grind plate coupled to the arch portion of the sole.

13. A method for transitioning from a stationary state to a rolling state on a surface, comprising:

contacting at least a portion of a forefoot portion of a sole of a footwear on a surface to inhibit rolling, the sole of the footwear also having a heel portion with a first wheel-well opening adjacent a first side of the heel portion and a second wheel-well opening adjacent a second side of the heel portion, the sole further having an arch portion, wherein the forefoot portion of the sole is inoperable for rolling on the surface and the first outer side of the forefoot portion of the sole and the second outer side of the forefoot portion of the sole are not configured to couple with a rolling means;

elevating the forefoot of the sole of the footwear relative to the surface such that either none or an insubstantial portion of a user's weight is supported by the forefoot;

rolling on the surface using a first wheel operable to rotate adjacent and at least partially within the first wheel-well opening of the heel portion of the sole and using a second wheel operable to rotate adjacent and at least partially within the second wheel-well opening of the heel portion of the sole while supporting at least a portion of the user's weight; and wherein the first wheel and the second wheel provide the primary contact with the surface to allow the user to roll on the surface, a change in mode being effected by a transfer in weight of the user from the forefoot portion to the first wheel and the second wheel.

14. The method of claim 13, further comprising grinding on a surface with a grind plate positioned in the arch portion of the sole of the footwear.

15. The method of claim 13, wherein the first wheel is positioned entirely within the first wheel-well opening.

16. The method of claim 13, further comprising an axle, and wherein the first wheel is rotatably coupled to the axle.

17. The method of claim 16, wherein the first wheel is removably coupled to the axle.

18. The method of claim 16, wherein the axle is removable.

* * * * *